US005773149A

United States Patent [19]

Yoshida et al.

[11] Patent Number: 5,773,149

[45] Date of Patent: Jun. 30, 1998

[54] THERMAL TRANSFER RECORDING MATERIAL

[75] Inventors: Katsuhiro Yoshida; Kotaro Akashiro, both of Osaka, Japan

[73] Assignee: Fujicopian Co., Ltd., Osaka, Japan

[21] Appl. No.: 684,146

[22] Filed: Jul. 19, 1996

Related U.S. Application Data

[62] Division of Ser. No. 505,470, Jul. 21, 1995, Pat. No. 5,658,667.

[30] Foreign Application Priority Data

| | | | |
|---|---|---|---|
| Jul. 22, 1994 | [JP] | Japan | 6-171271 |
| Aug. 31, 1994 | [JP] | Japan | 6-207302 |
| Sep. 16, 1994 | [JP] | Japan | 6-221417 |
| Oct. 13, 1994 | [JP] | Japan | 6-247963 |
| Nov. 8, 1994 | [JP] | Japan | 6-273611 |
| Dec. 20, 1994 | [JP] | Japan | 6-316946 |
| May 1, 1995 | [JP] | Japan | 7-107556 |
| May 1, 1995 | [JP] | Japan | 7-107557 |
| May 1, 1995 | [JP] | Japan | 7-107558 |
| May 1, 1995 | [JP] | Japan | 7-107559 |

[51] Int. Cl.[6] ..... B41M 5/26

[52] U.S. Cl. ..... 428/413; 428/195; 428/484; 428/913; 428/914

[58] Field of Search ..... 428/195, 484, 428/488.1, 413, 913, 914

[56] References Cited

U.S. PATENT DOCUMENTS

| | | | |
|---|---|---|---|
| 5,290,623 | 3/1994 | Kawahito et al. | 428/195 |
| 5,328,754 | 7/1994 | Yuyama et al. | 428/195 |

FOREIGN PATENT DOCUMENTS

| | | | |
|---|---|---|---|
| A-0 412 517 | 2/1991 | European Pat. Off. | B41M 5/38 |
| A-0 444 641 | 9/1991 | European Pat. Off. | B41M 5/38 |
| B-60-59159 | 12/1985 | Japan | B41M 5/26 |
| A-7-172070 | 7/1995 | Japan | B41M 5/26 |

OTHER PUBLICATIONS

*Derwent Database Abstract,* No. 87–104 184,citing Japanese patent application 62–50360, published Mar. 5, 1987.

*Derwent Database Abstract,* No. 89–160 081,citing Japanese patent application 1–100749, published Apr. 19, 1989.

*Primary Examiner*—Pamela R. Schwartz
*Attorney, Agent, or Firm*—Fish & Neave

[57] ABSTRACT

A thermal transfer recording material comprising a foundation and a heat-meltable ink layer comprising a vehicle and a pigment provided on the foundation, the vehicle comprising not less than 85% by weight of an epoxy resin, the epoxy resin comprising not less than 50% by weight of at least one of tetraphenolethane tetraglycidyl ether and a bromide thereof, cresol novolac polyglycidyl ether and a bromide thereof, and bisphenol F diglycidyl ether and a bromide thereof. The recording material has excellent transferability and gives printed images excellent heat resistance, solvent resistance and scratch resistance.

5 Claims, 1 Drawing Sheet

THERMAL TRANSFER RECORDING MATERIAL

This is a division of application Ser. No. 08/505,470, filed Jul. 21, 1995, entitled, THERMAL TRANSFER RECORDING MATERIAL now U.S. Pat. No. 5,658,667.

BACKGROUND OF THE INVENTION

The present invention relates to a thermal transfer recording material. More particularly, the present invention relates to a thermal transfer recording material for use in forming printed images having excellent heat resistance, solvent resistance, scratch resistance, and like properties.

Conventional common thermal transfer recording materials include one wherein a heat-meltable ink containing a wax as the main component of the vehicle thereof is applied on a foundation, and another wherein a heat-meltable ink containing a resin as the main component of the vehicle thereof, for the purpose of forming printed images of high quality even on a paper sheet having poor surface smoothness or forming printed images having good fastness.

Recently, bar code printers or label printers using a thermal transfer recording material have been used for printing bar codes or like codes which are used for management of parts or products in the production process of manufacturing factories, merchandise management in the distribution field, management of articles in the use field, and the like.

Among such articles to be given bar codes, there are those exposed to high temperatures after provision of bar codes. For example, a heat treatment at about 180° C. is conducted in production processes for printed wiring boards and a heat treatment at about 250° C. in inspection processes for semiconductors.

Bar codes or like codes used for product management in manufacturing factories or the like require good solvent resistance because they frequently come into contact with solvents, oils and the like, and bar codes or like codes used in the distribution field or the like require good scratch resistance because they are frequently subjected to rubbing.

Further, besides printing bar codes, thermal transfer printers have been used for the production of many products which are produced in small quantities, including outdoor advertising, election posters, general posters, standing signboards, stickers, catalogs, pamphlets, calendars, and the like in commercial printing field; bags for light packaging, labels for containers for foods, drinks, medicines, paints, and the like, and binding tapes in packaging field; labels for indicating quality characteristic, labels for process control, labels for product management, and the like in apparel field. These articles also require scratch resistance, solvent resistance or heat resistance.

However, there are no conventional thermal transfer recording materials which have excellent transferability and can form printed images meeting such heat resistance, solvent resistance and scratch resistance at the same time.

That is, although the above-mentioned conventional thermal transfer recording material with a heat-meltable ink layer whose vehicle is composed of a wax as a main component is good in transferability, the printed images obtained therefrom are sometimes collapsed when exposed to a high temperature of about 250° C. to become illegible, and are also poor in solvent resistance and scratch resistance. The above-mentioned conventional thermal transfer recording material with a heat-meltable ink layer whose vehicle is composed of a resin, such as ethylene-vinyl acetate copolymer, as a main component forms printed images which are comparatively good in heat resistance, solvent resistance and scratch resistance, but its transferability is inferior to that of the recording medium having the wax-predominant ink layer because of the high melt viscosity of its ink layer.

Further, a thermal transfer recording material using a heat-meltable ink containing bisphenol A diglycidyl ether as a vehicle is proposed (Japanese Examined Patent Publication No. 60-59159). However, this bisphenol A type epoxy resin has a disadvantage that a pigment such as carbon black is not favorably dispersed thereinto. For this reason, the recording material is poor in transferability, resulting in unclear printed images. With respect to recording materials for use in thermal transfer recording system, poor transferability is a fatal drawback.

An object of the present invention is to provide a thermal transfer recording material which has excellent transferability and can form printed images which have such heat resistance that they stand high temperatures up to about 280° C. and further have excellent solvent resistance and scratch resistance.

This and other objects of the present invention will become apparent from the description hereinafter.

SUMMARY OF THE INVENTION

According to the first aspect of the present invention, there is provided a thermal transfer recording material comprising a foundation and a heat-meltable ink layer comprising a vehicle and a pigment provided on the foundation, the vehicle comprising not less than 85% by weight of an epoxy resin, the epoxy resin comprising not less than 50% by weight of at least one of tetraphenolethane tetraglycidyl ether and a bromide thereof.

In an embodiment of the first aspect, the content of the epoxy resin in the vehicle is not less than 95% by weight.

In another embodiment of the first aspect, the thermal transfer recording material further comprises a layer comprising a wax provided between the foundation and the heat-meltable ink layer, the layer comprising the wax having a penetration of not more than 1.

In still another embodiment of the first aspect, there is provided a thermal transfer recording material for forming a color image comprising at least one region wherein a color is developed by virtue of subtractive color mixture of at least two superimposed inks selected from a yellow heat-meltable ink, a magenta heat-meltable ink and cyan heat-meltable ink, the thermal transfer recording material comprising a foundation, and a yellow heat-meltable ink layer, a magenta heat-meltable ink layer and a cyan heat-meltable ink layer provided on the foundation in a side-by-side relation, each of the respective color heat-meltable ink layers comprising a vehicle and a pigment, the vehicle comprising not less than 85% by weight of an epoxy resin, the epoxy resin comprising not less than 50% by weight of at least one of tetraphenolethane tetraglycidyl ether and a bromide thereof.

In a further embodiment of the first aspect, there is provided an assembly of plural thermal transfer recording materials for forming a color image comprising at least one region wherein a color is developed by virtue of subtractive color mixture of at: least two superimposed inks selected from a yellow heat-meltable ink, a magenta heat-meltable ink and cyan heat-meltable ink, the assembly comprising a first thermal transfer recording material comprising a foundation, and a yellow heat-meltable ink layer provided on the foundation, a second thermal transfer recording material comprising a foundation, and a magenta heat-meltable ink layer provided on the foundation, and a third thermal transfer recording material comprising a foundation, and a cyan heat-meltable ink layer provided on the foundation, each of the respective color heat-meltable ink layers comprising a vehicle and a pigment provided on the foundation, the vehicle comprising not less than 85% by weight of an epoxy resin, the epoxy resin comprising not less than 50% by weight of at least one of tetraphenolethane tetraglycidyl ether and a bromide thereof.

According to the second aspect of the present invention, there is provided a thermal transfer recording material comprising a foundation and a heat-meltable ink layer comprising a vehicle and a pigment provided on the foundation, the vehicle comprising not less than 85% by weight of an epoxy resin, the epoxy resin comprising not less than 50% by weight of at least one of cresol novolac polyglycidyl ether and a bromide thereof.

In an embodiment of the second aspect, the content of the epoxy resin in the vehicle is not less than 95% by weight.

In another embodiment of the second aspect, the thermal transfer recording material further comprises a layer comprising a wax provided between the foundation and the heat-meltable ink layer, the layer comprising the wax having a penetration of not more than 1.

In still another embodiment of the second aspect, there is provided a thermal transfer recording material for forming a color image comprising at least one region wherein a color is developed by virtue of subtractive color mixture of at least two superimposed inks selected from a yellow heat-meltable ink, a magenta heat-meltable ink and cyan heat-meltable ink, the thermal transfer recording material comprising a foundation, and a yellow heat-meltable ink layer, a magenta heat-meltable ink layer and a cyan heat-meltable ink layer provided on the foundation in a side-by-side relation, each of the respective color heat-meltable ink layers comprising a vehicle and a pigment, the vehicle comprising not less than 85% by weight of an epoxy resin, the epoxy resin comprising not less than 50% by weight of at least one of cresol novolac polyglycidyl ether and a bromide thereof.

In a further embodiment of the second embodiment, there is provided an assembly of plural thermal transfer recording materials for forming a color image comprising at least one region wherein a color is developed by virtue of subtractive color mixture of at least two superimposed inks selected from a yellow heat-meltable ink, a magenta heat-meltable ink and cyan heat-meltable ink, the assembly comprising a first thermal transfer recording material comprising a foundation, and a yellow heat-meltable ink layer provided on the foundation, a second thermal transfer recording material comprising a foundation, and a magenta heat-meltable ink Layer provided on the foundation, and a third thermal transfer recording material comprising a foundation, and a cyan heat-meltable ink layer provided on the foundation, each of the respective color heat-meltable ink layers comprising a vehicle and a pigment provided on the foundation, the vehicle comprising not less than 85% by weight of an epoxy resin, the epoxy resin comprising not less than 50% by weight of at least one of cresol novolac polyglycidyl ether and a bromide thereof.

According to the third aspect of the present invention, there is provided a thermal transfer recording material comprising a foundation and a heat-meltable ink layer comprising a vehicle and a pigment provided on the foundation, the vehicle comprising not less than 85% by weight of an epoxy resin, the epoxy resin comprising not less than 50% by weight of at least one of bisphenol F diglycidyl ether and a bromide thereof.

In an embodiment of the third aspect, the content of the epoxy resin in the vehicle is not less than 95% by weight.

In another embodiment of the third aspect, the bisphenol F diglycidyl ether is represented by formula (V):

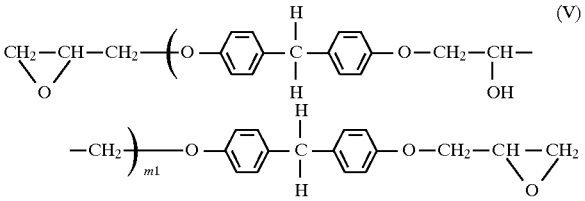

(V)

wherein ml is an integer of 0 to 33, and the bromide is represented by the formula (VI):

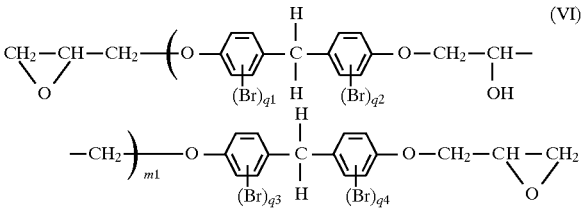

(VI)

wherein m2 is an integer of 0 to 33, and q1, q2, q3 and q4 are independently an integer of 1 or 2.

In still another embodiment of the third aspect, the total amount of the bisphenol F diglycidyl ether of formula (V) wherein m1 is 0 and/or the bromide of formula (VI) wherein m2 is 0 is not more than 2% by weight of the total amount of the bisphenol F diglycidyl ether of formula (V) and/or the bromide of formula (VI).

In a further embodiment of the third aspect, thermal transfer recording material further comprises a layer comprising a wax provided between the foundation and the heat-meltable ink layer, the layer comprising the wax having a penetration of not more than 1.

In a further embodiment of the third aspect, there is provided a thermal transfer recording material for forming a color image comprising at least one region wherein a color is developed by virtue of subtractive color mixture of at least two superimposed inks selected from a yellow heat-meltable ink, a magenta heat-meltable ink and cyan heat-meltable ink, the thermal transfer recording material comprising a foundation, and a yellow heat-meltable ink layer, a magenta heat-meltable ink layer and a cyan heat-meltable ink layer provided on the foundation in a side-by-side relation, each of the respective color heat-meltable ink layers comprising a vehicle and a pigment, the vehicle comprising not less than 85% by weight of an epoxy resin, the epoxy resin comprising not less than 50% by weight of at least one of bisphenol F diglycidyl ether and a bromide thereof.

In a further embodiment of the third aspect, there is provided an assembly of plural thermal transfer recording materials for forming a color image comprising at least one region wherein a color is developed by virtue of subtractive color mixture of at least two superimposed inks selected from a yellow heat-meltable ink, a magenta heat-meltable ink and cyan heat-meltable ink, the assembly comprising a first thermal transfer recording material comprising a foundation, and a yellow heat-meltable ink layer provided on the foundation, a second thermal transfer recording material comprising a foundation, and a magenta heat-meltable ink layer provided on the foundation, and a third thermal transfer recording material comprising a foundation, and a cyan heat-meltable ink layer provided on the foundation, each of the respective color heat-meltable ink layers comprising a vehicle and a pigment provided on the foundation, the vehicle comprising not less than 85% by weight of an epoxy resin, the epoxy resin comprising not less than 50% by weight of at least one of bisphenol F diglycidyl ether and a bromide thereof.

According to the fourth aspect of the present invention, there is provided a thermal transfer recording material comprising a foundation and a heat-meltable ink layer comprising a vehicle and a pigment provided on the foundation, the vehicle comprising not less than 85% by weight of an epoxy resin, the pigment having an oil absorption of not less than 80.

In an embodiment of the fourth aspect, the epoxy resin is at least one of bisphenol A diglycidyl ether and a bromide thereof.

In another embodiment of the fourth aspect, the thermal transfer recording material further comprises a layer comprising a wax provided between the foundation and the heat-meltable ink layer, the layer comprising the wax having a penetration of not more than 1.

DETAILED DESCRIPTION

Figure 1:
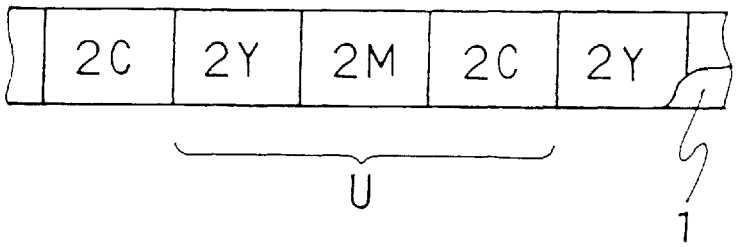
FIG. 1 is a partial plan view showing an example of arrangement of respective color ink layers in an embodiment of the thermal transfer recording material of the present invention.

The first aspect of the present invention will be explained below.

Tetraphenolethane tetraglycidyl ether (hereinafter referred to as "TPETGE" as the need arises) used in the first aspect is a type of polyfunctional epoxy resin represented by formula (I):

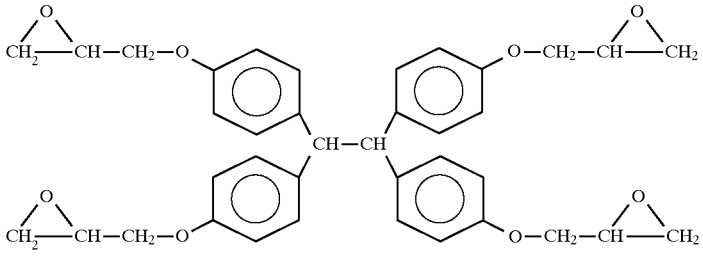

(I)

TPETGE has a softening point of 92° C.

A bromide of TPETGE (hereinafter referred to as "Br-TPETGE" as the need arises) used in the first aspect includes, for example, one represented by formula (II):

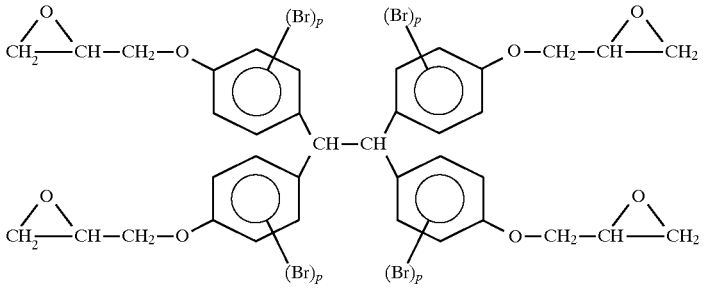

(II)

wherein p is usually an integer of 1 or 2. The bromine atom is usually substituted at the ortho position of the benzene ring with respect to the glycidyloxy group.

According to the first aspect of the present invention wherein, in a thermal transfer recording material comprising a foundation and a heat-meltable ink layer comprising a vehicle and a pigment provided on the foundation, the vehicle comprises not less than 85% (% by weight, hereinafter the same) of an epoxy resin, and the epoxy resin comprises not less than 50% of at least one of TPETGE and Br-TPETGE, the ability of the vehicle for dispersing a pigment thereinto is improved so that the transferability of the ink is improved, resulting in clear printed images, and the resulting printed images stand a high temperature up to about 280° C. and have excellent solvent resistance and scratch resistance.

According to the first embodiment of the first aspect wherein the content of the epoxy resin in the vehicle is not less than 95% , the heat resistance, solvent resistance and scratch resistance of the resulting printed images are further improved.

According to the second embodiment of the first aspect wherein a wax layer having a penetration of not more than 1 is provided between the foundation and the heat-meltable ink layer, the scratch resistance of the resulting printed images are further improved.

With use of the thermal transfer recording materials for color image formation according to the third and fourth embodiments of the first aspect, there are obtained printed images which have excellent heat resistance, scratch resistance and solvent resistance as well as excellent color reproducibility because of good superimposition of respective color heat-meltable ink layers.

The heat-meltable ink used in the first aspect of the present invention comprises a vehicle and a pigment. The vehicle comprises an epoxy resin and the epoxy resin contains not less than 50, preferably not less than 70% , of at least one of TPETGE and Br-TPETGE.

In the first aspect, the whole resin component in the vehicle may be composed of at least one of TPETGE and Br-TPETGE. This is not essential. The desired effect is exhibited so long as an epoxy resin component containing not less than 50% of at least one of TPETGE and Br-TPETGE is used. When the content of TPETGE and/or Br-TPETGE in total in the whole epoxy resin component is less than the above range, the dispersibility of a pigment into the vehicle is degraded, resulting in poor transferability.

The content of an epoxy resin component containing not less than 50% of at least one of TPETGE and Br-TPETGE in the vehicle is not less than 85% , preferably not less than 95% . When the content of the epoxy resin component in the vehicle is less than the above range, the desired effect is prone not to be exhibited.

The use of Br-TPETGE as the main component of the vehicle of the heat-meltable ink layer in the first aspect imparts flame resistance to the ink layer. For example, an ink layer having flame resistance passing UL Standard (UL-94V-O) can be obtained. Therefore, a thermal transfer recording material wherein a heat-meltable ink layer containing Br-TPETGE is provided on a flame-resistant foundation can be safely used in a high-temperature environment. In the case of a printed product obtained by forming printed images of a heat-meltable ink containing Br-TPETGE on a flame-resistant receptor, the printed images do not disappear even in a higher-temperature environment or even when exposed to flame.

Examples of epoxy resins usable together with TPETGE and/or Br-TPETGE in the first aspect of the present invention are as follows:

(1) Glycidyl ether type

Examples of epoxy resins of this type are bisphenol A diglycidyl ether, bisphenol F diglycidyl ether, brominated bisphenol A diglycidyl ether, brominated bisphenol F diglycidyl ether, hydrogenated bisphenol A diglycidyl ether, novolac polyglycidyl ether, cresol novolac polyglycidyl ether, glycerol triglycidyl ether, pentaerythritol diglycidyl ether, and the like.

(2) Glycidyl ether ester type

Examples of epoxy resins of this type are p-oxybenzoic acid diglycidyl ether ester, and the like.

(3) Glycidyl ester type

Examples of epoxy resins of this type are phthalic acid diglycidyl ester, tetrahydrophthalic acid diglycidyl ester, hexahydrophthalic acid diglycidyl ester, dimer acid diglycidyl ester, and the like.

(4) Glycidyl amine type

Examples of epoxy resins of this type are glycidylaniline, triglycidyl isocyanurate, and the like.

(5) Linear aliphatic epoxy type

Examples of epoxy resins of this type are epoxidized polybutadiene, epoxidized soybean oil, and the like.

(6) Alicyclic epoxy type

Examples of epoxy resins of this type are 3,4-epoxy-6-methylcyclohexylmethyl 3,4-epoxy-6-methylcyclohexanecarboxylate, 3,4-epoxycyclohexylmethyl 3,4-epoxycyclohexanecarboxylate, and the like.

The above-mentioned other epoxy resins can be used singly or as a mixture of two or more species thereof. Preferable as the other epoxy resins are those having a softening point of not less than 60° C. However, an epoxy resin in a liquid state can also be used so long as, when it is mixed with epoxy resins other than it, including TPETGE and Br-TPETGE, the resulting vehicle has a softening point of not less than 60° C.

The above-mentioned vehicle may be incorporated with one or more heat-meltable resins other than epoxy resins unless the purpose of the present invention is injured. Examples of such heat-meltable resins are ethylene-vinyl acetate copolymer resin, ethylene-alkyl (meth)acrylate copolymer resin, phenol resin, styrene-acrylic monomer copolymer resin, polyester resin and polyamide resin. Preferably, such heat-meltable resin is used in an amount of not more than 15% , more preferably not more than 5% , on the basis of the total amount of the vehicle.

The softening point of the vehicle is preferably from 60° to 120° C. in view of the storage stability and transferability of the thermal transfer recording material.

The content of the vehicle in the heat-meltable ink is preferably from 40 to 95% by weight in view of the transferability and a like property.

The second aspect of the present invention will be explained below.

Cresol novolac polyglycidyl ether (hereinafter referred to as "CNPGE" as the need arises) used in the second aspect is a type of polyfunctional epoxy resin. Preferred is one represented by formula (III):

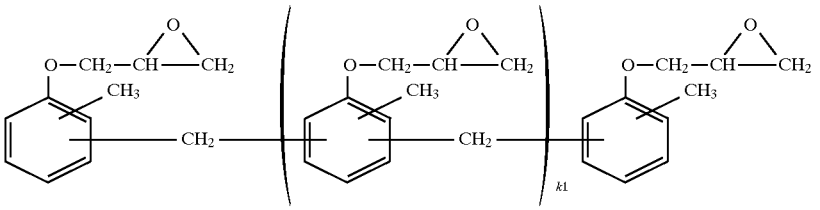

(III)

wherein k1 is usually an integer of 3 to 7. CNPGE used in the present invention includes a mixture of those of formula (III) wherein the values for k1 are different from each other. CNPGE preferably has a softening point of 60° to 120° C.

A bromide of CNPGE (hereinafter referred to as "Br-CNPGE" as the need arises) used in the second aspect includes, for example, one represented by formula (IV):

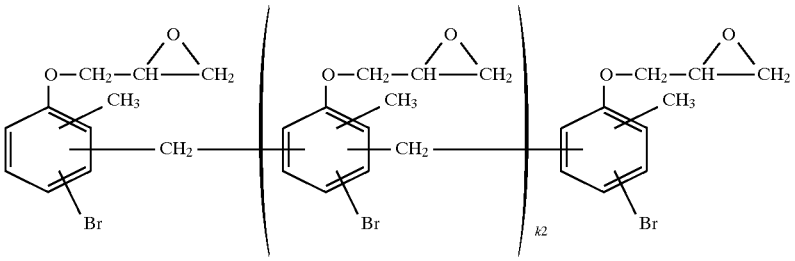

(IV)

wherein k2 is usually an integer of 3 to 7. Br-CNPGE used in the second aspect includes a mixture of those of formula (IV) wherein the values for k2 are different from each other. Br-CNPGE preferably has a softening point of 60° to 120° C.

According to the second aspect of the present invention wherein, in a thermal transfer recording material comprising a foundation and a heat-meltable ink layer comprising a vehicle and a pigment provided on the foundation, the vehicle comprises not less than 85% of an epoxy resin, and the epoxy resin comprises not less than 50% of at least one of CNPGE and Br-CNPGE, the ability of the vehicle for dispersing a pigment thereinto is improved so that the transferability of the ink is improved, resulting in clear printed images, and the resulting printed images stand a high temperature up to about 280° C. and have excellent solvent resistance and scratch resistance.

According to the first embodiment of the second aspect wherein the content of the epoxy resin in the vehicle is not less than 95% , the heat resistance, solvent resistance and scratch resistance of the resulting printed images are further improved.

According to the second embodiment of the second aspect wherein a wax layer having a penetration of not more than 1 is provided between the foundation and the heat-meltable ink layer, the scratch resistance of the resulting printed images are further improved.

With use of the thermal transfer recording materials for color image formation according to the third and fourth embodiments of the second aspect, there are obtained printed images which have excellent heat resistance, scratch resistance and solvent resistance as well as excellent color reproducibility because of good superimposition of respective color heat-meltable ink layers.

The heat-meltable ink used in the second aspect of the present invention comprises a vehicle and a pigment. The vehicle comprises an epoxy resin and the epoxy resin contains not less than 50, preferably not less than 70% , of at least one of CNPGE and Br-CNPGE.

In the second aspect, the whole resin component in the vehicle may be composed of at least one of CNPGE and Br-CNPGE. This is not essential. The desired effect is exhibited so long as an epoxy resin component containing not less than 50% of at least one of CNPGE and Br-CNPGE is used. When the content of CNPGE and/or Br-CNPGE in total in the whole epoxy resin component is less than the above range, the dispersibility of a pigment into the vehicle is degraded, resulting in poor transferability.

The content of an epoxy resin component containing not less than 50% of at least one of CNPGE and Br-CNPGE in the vehicle is not less than 85% , preferably not less than 95% . When the content of the epoxy resin component in the vehicle is less than the above range, the desired effect is prone not to be exhibited.

The use of Br-CNPGE as the main component of the vehicle of the heat-meltable ink layer in the second aspect imparts flame resistance to the ink layer. For example, an ink layer having flame resistance passing UL standard (UL-94V-O) can be obtained. Therefore, a thermal transfer recording material wherein a heat-meltable ink layer containing Br-CNPGE is provided on a flame-resistant foundation can be safely used in a high-temperature environment. In the case of a printed product obtained by forming printed images of a heat-meltable ink containing Br-CNPGE on a flame-resistant receptor, the printed images do not disappear even in a higher-temperature environment or even when exposed to flame.

Examples of epoxy resins usable together with CNPGE and/or Br-CNPGE in the second aspect of the present invention are as follows:

(1) Glycidyl ether type

Examples of epoxy resins of this type are bisphenol A diglycidyl ether, bisphenol F diglycidyl ether, brominated bisphenol A diglycidyl ether, brominated bisphenol F diglycidyl ether, hydrogenated bisphenol A diglycidyl ether, novolac polyglycidyl ether, glycerol triglycidyl ether, pentaerythritol diglycidyl ether, tetraphenolethane tetraglycidyl ether, and the like.

(2) Glycidyl ether ester type

Examples of epoxy resins of this type are p-oxybenzoic acid diglycidyl ether ester, and the like.

(3) Glycidyl ester type

Examples of epoxy resins of this type are phthalic acid diglycidyl ester, tetrahydrophthalic acid diglycidyl ester, hexahydrophthalic acid diglycidyl ester, dimer acid diglycidyl ester, and the like.

(4) Glycidyl amine type

Examples of epoxy resins of this type are glycidylaniline, triglycidyl isocyanurate, and the like.

(5) Linear aliphatic epoxy type

Examples of epoxy resins of this type are epoxidized polybutadiene, epoxidized soybean oil, and the like.

(6) Alicyclic epoxy type

Examples of epoxy resins of this type are 3,4-epoxy-6-methylcyclohexylmethyl 3,4-epoxy-6-methylcyclohexanecarboxylate, 3,4-epoxycyclohexylmethyl 3,4-epoxycyclohexanecarboxylate, and the like.

The above-mentioned other epoxy resins can be used singly or as a mixture of two or more species thereof. Preferable as the other epoxy resins are those having a softening point of not less than 60° C. However, an epoxy resin in a liquid state can also be used so long as, when it is mixed with epoxy resins other than it, including CNPGE and Br-CNPGE, the resulting vehicle has a softening point of not less than 60° C.

The above-mentioned vehicle may be incorporated with one or more heat-meltable resins other than epoxy resins unless the purpose of the present invention is injured. Examples of such heat-meltable resins are ethylene-vinyl acetate copolymer resin, ethylene-alkyl (meth)acrylate copolymer resin, phenol resin, styrene-acrylic monomer copolymer resin, polyester resin and polyamide resin. Preferably, such heat-meltable resin is used in an amount of not more than 15% , more preferably not more than 5% , on the basis of the total amount of the vehicle.

The softening point of the vehicle is preferably from 60° to 120° C. in view of the storage stability and transferability of the thermal transfer recording material.

The content of the vehicle in the heat-meltable ink is preferably from 40 to 95% by weight in view of the transferability and a like property.

The third aspect of the present invention will be explained below.

Bisphenol F diglycidyl ether (hereinafter referred to as "BPFDGE" as the need arises) used in the third aspect is a type of difunctional epoxy resin. Preferred is one represented by formula (V):

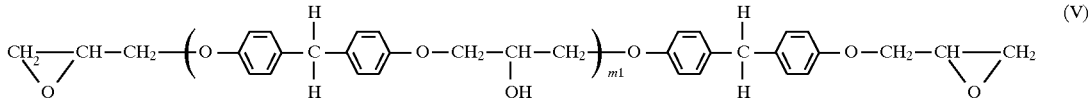

(V)

wherein m1 is usually an integer of 0 to 33. BPFDGE used in the present invention includes a mixture of those of formula (V) wherein the values for m1 are different from each other.

BPFDGE preferably has a softening point of 60° to 140° C.

A bromide of BPFDGE (hereinafter referred to as "Br-BPFDGE" as the need arises) used in the third aspect includes, for example, one represented by formula (VI):

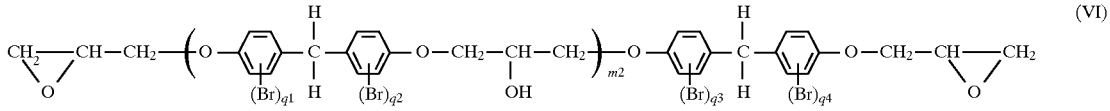

(VI)

wherein m2 is usually an integer of 0 to 33, and q1, q2, q3 and q4 are independently an integer of 1 or 2. In formula (VI), the bromine atom is usually substituted at the meta position of the benzene ring with respect to the methylene group of the bisphenol F skelton. Br-BPFDGE used in the third aspect includes a mixture of those of formula (VI) wherein the values for m2 are different from each other. Br-BPFDGE preferably has a softening point of 60° to 140° C. A typical example of Br-BPFDGE is one represented by formula (VII):

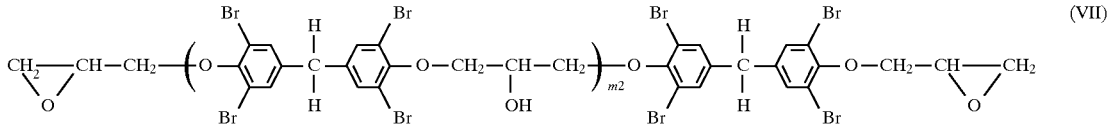

(VII)

wherein m2 is the same as in formula (VI).

According to the third aspect of the present invention wherein, in a thermal transfer recording material comprising a foundation and a heat-meltable ink layer comprising a vehicle and a pigment provided on the foundation, the vehicle comprises not less than 85% of an epoxy resin, and the epoxy resin comprises not less than 50% of at least one of BPFDGE and Br-BPFDGE, the ability of the vehicle for dispersing a pigment thereinto is improved so that the transferability of the ink is improved, resulting in clear printed images, and the resulting printed images stand a high temperature up to about 280° C. and have excellent solvent resistance (against solvents such as kerosene, gasoline, ethanol, toluene and carbon tetrachloride) and scratch resistance.

According to the first embodiment of the third aspect wherein the content of the epoxy resin in the vehicle is not less than 95% by weight, the heat resistance, solvent resistance and scratch resistance of the resulting printed images are further improved.

According to the second embodiment of the third aspect wherein BPFDGE is specified to one represented by formula (V) and Br-BPFDGE is specified to one represented by formula (VI), excellent transferability and like properties are assured.

According to the third embodiment of the third aspect wherein the total amount of BPFDGE of formula (V) wherein m1 is 0 and/or Br-BPFDGE of formula (VI) wherein m2 is 0 is not more than 2% of the total amount of BPFDGE of formula (V) and/or Br-BPFDGE formula (VI), the ethanol resistance and toluene resistance of the resulting printed images are further improved.

According to the fourth embodiment of the third aspect wherein a wax layer having a penetration of not more than 1 is provided between the foundation and the heat-meltable ink layer, the toluene resistance and scratch resistance of the resulting printed images are further improved.

With use of the thermal transfer recording materials for color image formation according to the fifth and sixth embodiments of the third aspect, there are obtained printed images which have excellent heat resistance, scratch resistance and solvent resistance as well as excellent color reproducibility because of good superimposition of respective color heat-meltable ink layers.

The heat-meltable ink used in the third aspect of the present invention comprises a vehicle and a pigment. The vehicle comprises an epoxy resin and the epoxy resin contains not less than 50, preferably not less than 70% , of at least one of BPFDGE and Br-BPFDGE.

In the third aspect, the whole resin component in the vehicle may be composed of at least one of BPFDGE and Br-BPFDGE. This is not essential. The desired effect is exhibited so long as an epoxy resin component containing not less than 50% of at least one of BPFDGE and Br-BPFDGE is used. Although a vehicle composed of at least one of BPFDGE and Br-BPFDGE together with other epoxy resin provides considerably improved results, the vehicle does not necessarily provide satisfactory solvent resistance and dispersibility of a pigment into the vehicle, the latter resulting in undesirable transferability. Accordingly, it is especially preferable to use an epoxy resin component composed of BPFDGE and/or Br-BPFDGE alone. When the content of BPFDGE and/or Br-BPFDGE in total in the whole epoxy resin. component is less than the above range, the dispersibility of a pigment into the vehicle is degraded, resulting in poor transferability.

The content of an epoxy resin component containing not less than 50% of at least one of BPFDGE and Br-BPFDGE in the vehicle is not less than 85% , preferably not less than 95% . When the content of the epoxy resin component in the vehicle is less than the above range, the desired effect is prone not to be exhibited.

In the third aspect, it is preferable that the total amount of BPFDGE of formula (V) wherein m1 is 0 and/or Br-BPFDGE of formula (VI) wherein m2 is 0 is not more than 2% , more preferably not more than 1.5% , of the total amount of BPFDGE of formula (V) and/or Br-BPFDGE of formula (VI). When the total amount of BPFDGE of formula (V) wherein m1=0 and/or Br-BPFDGE of formula (VI) wherein m2=0 is more than the above range, solvent resistance, particularly ethanol resistance and toluene resistance, is not satisfactorily improved.

The use of Br-BPFDGE as the main component of the vehicle of the heat-meltable ink layer in the third aspect imparts flame resistance to the ink layer. For example, an ink layer having flame resistance passing UL Standard (UL-94V-O) can be obtained. Therefore, a thermal transfer recording material wherein a heat-meltable ink layer containing Br-BPFDGE is provided on a flame-resistant foundation can be safely used in a high-temperature environment. In the case of a printed product obtained by forming printed images of a heat-meltable ink containing Br-BPFDGE on a flame-resistant receptor, the printed images do not disappear even in a higher-temperature environment or even when exposed to flame.

Examples of epoxy resins usable together with BPFDGE and/or Br-BPFDGE in the third aspect of the present invention are as follows:

(1) Glycidyl ether type

Examples of epoxy resins of this type are bisphenol A diglycidyl ether, brominated bisphenol A diglycidyl ether, hydrogenated bisphenol A diglycidyl ether, novolac polyglycidyl ether, cresol novolac polyglycidyl ether, glycerol triglycidyl ether, pentaerythritol diglycidyl ether, tetraphenolethane tetraglycidyl ether, and the like.

(2) Glycidyl ether ester type

Examples of epoxy resins of this type are p-oxybenzoic acid diglycidyl ether ester, and the like.

(3) Glycidyl ester type

Examples of epoxy resins of this type are phthalic acid diglycidyl ester, tetrahydrophthalic acid diglycidyl ester, hexahydrophthalic acid diglycidyl ester, dimer acid diglycidyl ester, and the like.

(4) Glycidyl amine type

Examples of epoxy resins of this type are glycidylaniline, triglycidyl isocyanurate, and the like.

(5) Linear aliphatic epoxy type

Examples of epoxy resins of this type are epoxidized polybutadiene, epoxidized soybean oil, and the like.

(6) Alicyclic epoxy type

Examples of epoxy resins of this type are 3,4-epoxy-6-methylcyclohexylmethyl 3,4-epoxy-6-methylcyclohexanecarboxylate, 3,4-epoxycyclohexylmethyl 3,4-epoxycyclohexanecarboxylate, and the like.

The above-mentioned other epoxy resins can be used singly or as a mixture of two or more species thereof. Preferable as the other epoxy resins are those having a softening point of not less than 60° C. However, an epoxy resin in a liquid state can also be used so long as, when it is mixed with epoxy resins other than it, including BPFDGE and Br-BPFDGE, the resulting vehicle has a softening point of not less than 60° C.

The above-mentioned vehicle may he incorporated with one or more heat-meltable resins other than epoxy resins unless the purpose of the present invention is injured. Examples of such heat-meltable resins are ethylene-vinyl acetate copolymer resin, ethylene-alkyl (meth)acrylate copolymer resin, phenol resin, styrene-acrylic monomer copolymer resin, polyester resin and polyamide resin. Preferably, such heat-meltable resin is used in an amount of not more than 15% , more preferably not more than 5% , on the basis of the total amount of the vehicle.

The softening point of the vehicle is preferably from 60° to 120° C. in view of the storage stability and transferability of the thermal transfer recording material.

The content of the vehicle in the heat-meltable ink is preferably from 40 to 95% by weight in view of the transferability and a like property.

The fourth aspect of the present invention will be explained below.

As described previously, generally, bisphenol A diglycidyl ether is poor in ability of dispersing a pigment such as carbon black thereinto. In the present invention, however, it has been found that a pigment, such as carbon black, having an oil absorption of not less than 80 is unexpectedly favorably dispersed into bisphenol A diglycidyl ether and, or a bromide of bisphenol A diglycidyl ether.

Herein, the term "oil absorption" of a pigment means the amount (m1) of dibutyl phthalate which 100g of a pigment absorbs.

A heat-meltable ink obtained by dispersing a pigment having an oil absorption of not less, than 80 into bisphenol A diglycidyl ether and/or its bromide provides an excellent transferability because the pigment is uniformly dispersed therein, resulting in clear printed images having a high density.

When a pigment having an oil absorption of not less than 80 is dispersed into an epoxy resin other than bisphenol A diglycidyl ether or its bromide, the dispersibility of the pigment is also improved. However, when a pigment having an oil absorption of not less than 80 is dispersed into bisphenol A diglycidyl ether and/or its bromide, the dispersibility of the pigment is markedly improved.

The heat-meltable ink used in the fourth aspect of the present invention comprises a vehicle and a pigment. The vehicle comprises not less than 85% of an epoxy resin and the pigment has an oil absorption of not less than 80. The use of a pigment having an excessively large oil absorption provides an ink coating liquid having poor flowability, resulting in poor coating property. From this point of view, a pigment having an oil absorption of not more than about 330 is preferably used.

The heat-meltable ink layer has excellent transferability because the pigment is uniformly dispersed therein, resulting in clear printed image, of a high density, and the resulting printed images stand a high-temperature up to about 280° C. about and have excellent solvent resistance against solvents such as kerosene, gasoline, ethanol and carbon tetrachloride, and excellent scratch resistance because the vehicle contains not less than 85% of an epoxy resin.

When the content of the epoxy resin in the vehicle is less than 85% , in particular, the scratch resistance is degraded.

According to the first embodiment of the fourth aspect wherein the total amount of bisphenol A diglycidyl ether and/or a bromide thereof is not less than 50, preferably, substantially 100% of the total amount of the epoxy resin component, the above-mentioned effect of improving the dispersibility of the pigment is markedly exhibited.

Bisphenol A diglycidyl ether (hereinafter referred to as "BPADGE" as the need arises) used in the fourth aspect is a type of difunctional epoxy resin. Preferred is one represented by formula (VIII):

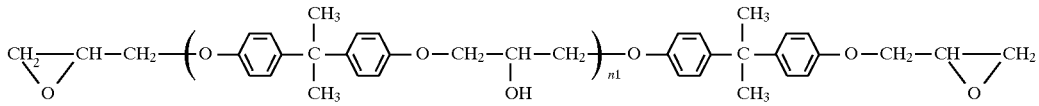

(VIII)

wherein n1 is usually an integer of 0 to 13. BPADGE used in the present invention includes a mixture of those of formula (VIII) wherein the values for n1 are different from each other. BPADGE preferably has a softening point of 60° to 140° C. A bromide of BPADGE (hereinafter referred to as "Br-BPADGE" as the need arises) used in the fourth aspect includes, for example, one represented by formula (IX):

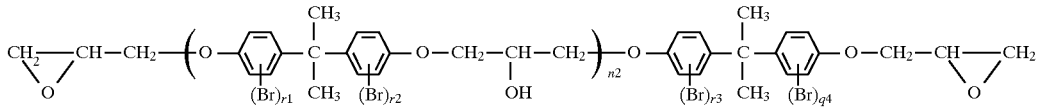

(IX)

wherein n2 is usually an integer of 0 to 13, and r1, r2, r3 and r4 are independently an integer of 1 or 2. In formula (IX), the bromine atom is usually substituted at the meta position of the benzene ring with respect to the methylene group of the bisphenol A skelton. Br-BPADGE used in the fourth aspect includes a mixture those of formula (IX) wherein the values for n2 are different from each other. Br-BPADGE preferably has a softening point of 60° to 140° C. A typical example of Br-BPADGE is one represented by formula (X):

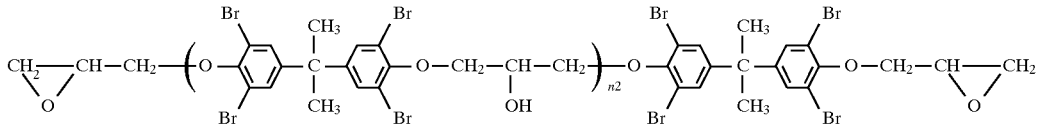

(X)

wherein n2 is the same as in formula (IX).

According to the second embodiment of the fourth aspect wherein a wax layer having a penetration of not more than 1 is provided between the foundation and the heat-meltable ink layer, the scratch resistance of the resulting printed images are further improved.

The use of Br-BPADGE as the main component of the vehicle of the heat-meltable ink layer in the fourth aspect imparts flame resistance to the ink layer. For example, an ink layer having flame resistance passing UL Standard (UL-94V-O) can be obtained. Therefore, a thermal transfer recording material wherein a heat-meltable ink layer containing Br-BPADGE is provided on a flame-resistant foundation can be safely used in a high-temperature environment. In the case of a printed product obtained by forming printed images of a heat-meltable ink containing Br-BPADGE on a flame-resistant receptor, the printed images do not disappear even in a higher-temperature environment or even when exposed to flame.

Examples of epoxy resins usable singly or together with BPADGE and/or Br-BPADGE in the fourth aspect of the present invention are as follows:

(1) Glycidyl ether type

Examples of epoxy resins of this type are bisphenol F diglycidyl ether, brominated bisphenol F diglycidyl ether, hydrogenated bisphenol A diglycidyl ether, novolac polyglycidyl ether, cresol novolac polyglycidyl ether, glycerol triglycidyl ether, pentaerythritol diglycidyl ether, tetraphenolethane tetraglycidyl ether, and the like.

(2) Glycidyl ether ester type

Examples of epoxy resins of this type are p-oxybenzoic acid diglycidyl ether ester, and the like.

(3) Glycidyl ester type

Examples of epoxy resins of this type are phthalic acid diglycidyl ester, tetrahydrophthalic acid diglycidyl ester, hexahydrophthalic acid diglycidyl ester, dimer acid diglycidyl ester, and the like.

(4) Glycidyl amine type

Examples of epoxy resins of this type are glycidylaniline, triglycidyl isocyanurate, and the like.

(5) Linear aliphatic epoxy type

Examples of epoxy resins of this type are epoxidized polybutadiene, epoxidized soybean oil, and the like.

(6) Alicyclic epoxy type

Examples of epoxy resins of this type are 3,4-epoxy-6-methylcyclohexylmethyl 3,4-epoxy-6-methylcyclohexanecarboxylate, 3,4-epoxycyclohexylmethyl 3,4-epoxycyclohexanecarboxylate, and the like.

The above-mentioned epoxy resins can be used singly or as a mixture of two or more species thereof. Preferable as the epoxy resins are those having a softening point of not less than 60° C. However, an epoxy resin in a liquid state can also be used so long as, when it is mixed with epoxy resins other than it, including BPADGE and Br-BPADGE, the resulting vehicle has a softening point of not less than 60° C.

The above-mentioned vehicle may be incorporated with one or more heat-meltable resins other than epoxy resins unless the purpose of the present invention is injured. Examples or such heat-meltable resins are ethylene-vinyl acetate copolymer resin, ethylene-alkyl (meth)acrylate copolymer resin, phenol resin, styrene-acrylic monomer copolymer resin, polyester resin and polyamide resin. Preferably, such heat-meltable resin is used in an amount of not more than 15% , more preferably not more than 5% , on the basis of the total amount of the vehicle.

The softening point of the vehicle is preferably from 60° to 120° C. in view of the storage stability and transferability of the thermal transfer recording material.

The content of the vehicle in the heat-meltable ink is preferably from 40 to 95% by weight in view of the transferability and a like property.

Usable as a pigment in the fourth aspect are those having an oil absorption of not less than 80, preferably not less than 110. A pigment having an oil absorption of less than the above range provides poor dispersibility against epoxy resins, particularly BPADGE and/or Br-BPADGE.

Hereinafter, descriptions common to the first, second, third and fourth aspects of the present invention will be given unless otherwise noted.

Usable as the pigment for the heat-meltable ink in the present invention are various organic and inorganic pigments as well as carbon black. Examples of organic and inorganic pigments are azo pigments (such as insoluble azo pigments, azo lake pigments and condensed azo pigments), phthalocyanine pigments, nitro pigments, nitroso pigments, anthraquinonoid pigments, nigrosine pigments, quinacridone pigments, perylene pigments, isoindolinone pigments, dioxazine pigments, titanium white, calcium carbonate and barium sulfate. The content of the pigment in the ink layer is preferably from 5 to 60%.

Yellow pigments, magenta pigments, and cyan pigments, and optionally black pigments are used for forming multicolor or full-color printed images utilizing subtractive color mixture.

The pigments for yellow, magenta and cyan as used in the ink layer are preferably transparent ones. Usable as the black pigments are usually opaque ones.

Examples of transparent yellow pigments include organic pigments such as Naphthol Yellow S, Hansa Yellow 5G, Hansa Yellow 3G, Hansa Yellow G, Hansa Yellow GR, Hansa Yellow A, Hansa Yellow RN, Hansa Yellow R, Benzidine Yellow, Benzidine Yellow G, Benzidine Yellow GR, Permanent Yellow NCG and Quinoline Yellow Lake. These pigments may be used singly or in combination of two or more species thereof.

Examples of transparent magenta pigments include organic pigments such as Permanent Red 4R, Brilliant Fast Scarlet, Brilliant Carmine BS, Permanent Carmine FB, Lithol Red, Permanent Red F5R, Brilliant Carmine 6B, Pigment Scarlet 3B, Rhodamine Lake B., Rhodamine Lake Y, Arizalin Lake and Quinacridone Red. These pigments may be used singly or in combination of two or more species thereof.

Examples of transparent cyan pigments include organic pigments such as Victoria Blue Lake, metal-free Phthalocyanine Blue, Phthalocyanine Blue and Fast Sky Blue. These pigments may be used singly or in combination of two or more species thereof.

The term "transparent pigment" is herein meant by a pigment which gives a transparent ink when dispersed in a transparent vehicle.

Examples of the black pigments include inorganic pigments such as carbon black, and organic pigments such as Aniline Black. These pigments may be used singly or in combination of two or more species thereof.

In the fourth aspect of the present invention, pigments having an oil absorption of not less than 80 are used.

The content of the pigment in each of the respective color ink layers is usually from about 5 to about 60%.

The heat-meltable ink layer used in the present invention can be incorporated with additives such as dispersing agent, besides the above-mentioned components.

The heat-meltable ink layer in the present invention can be formed by applying a coating liquid prepared by dissolving the above-mentioned vehicle components into a solvent and dissolving or dispersing the pigment and other additives, followed by drying. The coating amount (on a solid basis, hereinafter the same) of the heat-meltable ink layer in the present invention is preferably from 0.02 to 5 g/m$^2$, more preferably from 0.5 to 3 g/m$^2$.

As the foundation for the thermal transfer recording material of the present invention, there can be used polyester films such as polyethylene terephthalate film, polybutylene terephthalate film, polyethylene naphthalate film and polyarylate film, polycarbonate film, polyamide film, aramid film, polyether sulfone film, polysulfone film, polyphenylene sulfide film, polyether ether ketone film, polyether imide film, modified polyphenylene ether film and poyacetal film, and other various plastic films commonly used for the foundation of ink ribbons of this type. Thin paper sheets of high density such as condenser paper can also be used. The thickness of the foundation is usually frog. about 1 to about 10$\mu$m. From the view point of reducing heat spreading to increase the resolution of printed images, the thickness of the foundation is preferably from 1 to 6 $\mu$m.

In the case that the thermal transfer recording material of the present invention is used in a thermal transfer printer equipped with a thermal head, a conventionally known stick-preventive layer is preferably provided on the back side (the side adapted. to come into slide contact with the thermal head) of the foundation. Examples of the materials for the stick-preventive layer include various heat-resistant resins such as silicone resins, fluorine-containing resins and nitrocellulose resins, and other resins modified with these heat-resistant resins, such as silicone-modified urethane resins and silicone-modified acrylic resins, and mixtures of the foregoing heat-resistant resins and lubricating agents.

In the preferred embodiment of the present invention, a wax layer having a penetration of not more than 1 is provided between the foundation and the heat-meltable ink layer. With the printed image obtained by using the thermal transfer recording material of such construction, the surface of the printed image is covered with the colorless hard wax layer having a penetration of not more than 1 and, hence, the scratch resistance of the printed image is further improved due to good lubricity of the surface of the wax layer and the protection effect by the wax layer. The resistance to ethanol is also further improved. When a wax layer having a penetration of more than 1 is used, the scratch resistance is rather degraded.

Herein, the penetration is measured at 25° C. according to the penetration measuring method provided in JIS K 2235.

Usable as the wax for the wax layer are carnauba wax, polyethylene wax, and the like. These waxes can be used singly or in combination.

The wax layer can be formed by applying a solvent solution, solvent dispersion or aqueous emulsion of the wax onto the foundation, followed by drying. The wax layer can also be formed by a hot-melt coating method.

The coating amount of the wax layer is usually from 0.01 to 2.0 g/m$^2$, preferably from 0.1 to 1.0 g/m$^2$. When the coating amount of the wax layer is less than the above range, the desired effect is riot sufficiently exhibited. When the coating amount of the wax layer is more than the above range, the transferability is degraded in some cases.

The thermal transfer recording material of the present invention includes a thermal transfer recording material form for forming a monochromatic image and a thermal transfer recording material for forming a multi-color or full-color image utilizing subtractive color mixture.

The thermal transfer recording material for forming a monochromatic image has a structure wherein a monochromatic heat-meltable ink layer is provided on a foundation. Examples of the color for the heat-meltable ink layer are black, red, blue, green, yellow, magenta and cyan.

An embodiment of the color thermal transfer recording material for forming a multi-color or full-color image has a structure wherein on a single foundation are disposed a yellow heat-meltable ink layer, a magenta heat-meltable ink layer and a cyan heat-meltable ink layer, and, optionally, a black heat-meltable ink layer in a side-by-side relation. Various manners can be adopted for disposing the respective color ink layers on the foundation and a suitable manner is determined depending upon the kind of printer.

FIG. 1 is a partial plan view showing an example of the thermal transfer recording material in accordance with the aforesaid embodiment. In FIG. 1, on a single foundation 1 are disposed a yellow heat-melt able ink layer 2Y, a magenta heat-meltable ink layer 2M and a cyan heat-meltable ink layer 2C in a side-by-side relation The ink layer 2Y, the ink layer 2M and the ink layer 2C, each of which has a predetermined constant size, are periodically repeatedly disposed in a side-by-side relation in the longitudinal direction of the foundation 1 in a repeating unit U comprising the ink layers 2Y, 2M and 2C arranged in a predetermined order. The order of arrangement of these three color ink layers in the repeating unit U can be suitably determined according to the order of transfer of the respective color ink layers. A black ink layer may be included in the repeating unit U.

Another embodiment of the color thermal transfer recording material for forming a multi-color or full-color image is a set comprising a first thermal transfer recording material wherein a yellow heat-meltable ink layer is provided on a foundation, a second thermal transfer recording material wherein a magenta heat-meltable ink layer is provided on a foundation, and a third thermal transfer recording material wherein a cyan heat-meltable ink layer is provided on a foundation, and, optionally, a fourth thermal transfer recording material wherein a black heat-meltable ink layer is provided on a foundation.

The use of each of the aforesaid thermal transfer recording materials can give a multi-color or full-color image having excellent heat resistance, scratch resistance and solvent resistance. Further, the respective color heat-meltable ink layers in the present invention are excellent in superimposing property, resulting in a multi-color or full-color image having excellent color reproducibility.

When the wax layer is provided between the foundation and each color ink layer, the superimposing property of the respective color ink layers is prone to be degraded, and, hence, it is preferable not to provide the wax layer in the thermal transfer recording material for color image formation.

The formation of printed images with use of the thermal transfer recording material of the present invention can be performed by superimposing the ink layer of the thermal transfer recording material onto an image-receiving body and applying imagewise heat energy to the ink layer. A thermal head is generally used as a heat source for the heat energy. However, any conventional heat sources such as laser light, infrared flash and heat pen can be used.

When the image-receiving body is not a sheet-like material but a three-dimensional article, or one having a curved surface, thermal transfer using laser light is advantageous.

The formation of a multi-color or full-color image with use of the thermal transfer recording material of the present invention is preferably performed as follows: With use of a thermal transfer printer, the yellow ink layer, the magenta ink layer and the cyan ink layer are selectively melt-transferred onto a receptor in a predetermined order according to separation color signals of an original multi-color or full-color image, i.e. yellow signals, magenta signals and cyan signals to form yellow ink dots, magenta ink dots and cyan ink dots on the receptor in a predetermined order, yielding a yellow separation image, a magenta separation image and a cyan separation image superimposed on the receptor. The order of transfer of the yellow ink layer, the magenta ink layer and the cyan ink layer can be determined as desired. When a usual full-color or multi-color image is formed, all the three color ink layers are selectively transferred according to three color signals to form three color separation images on the receptor. When only two color signals are present, the corresponding two of the three color ink layers are selectively transferred to form two color separation images of a yellow separation image, a magenta separation image and a cyan separation image.

Thus there is obtained a Multi-color or full-color image comprising (A) at least one region wherein a color is developed by virtue of subtractive color mixture of at least two superimposed inks of yellow, magenta and cyan, or (B) a combination of the region (A), and at least one region of single color selected from yellow, magenta and cyan wherein different color inks are not superimposed. Herein a region where yellow ink dots and magenta ink dots are present in a superimposed state develops a red color; a region where yellow ink dots and cyan ink dots are present in a superimposed state develops a green color; a region where magenta ink dots and cyan ink dots are present in a superimposed state develops a blue color; and a region where yellow ink dots, magenta ink dots and cyan ink dots are present in a superimposed state develops a black color. A region where only yellow ink dots, magenta ink dots or cyan ink dots are present in a non-superimposed state develops a yellow color, a magenta color or a cyan color.

In the above manner, a black color is developed by the superimposing of yellow ink dots, magenta ink dots and cyan ink dots. However, a black color may be obtained by using only black ink dots instead of using three color ink dots. In that case, the black color may be obtained by superimposing black ink dots on at least one of yellow ink dots, magenta ink dots and cyan ink dots, or on superimposed ink dots of at least two of yellow ink dots, magenta ink dots and cyan ink dots.

The thermal transfer recording material of the present invention is favorably used for forming printed images on an object which is subjected to a heat treatment at a temperature of not less than 150° C., because the recording material gives printed images having excellent heat resistance as described above. When the temperature for the heat treatment which an object is subjected to is too high, the vehicle component of the printed image is prone to be decomposed so that the shape as the printed image is lost. Therefore, it is preferable that the temperature for the heat treatment which the object is subjected to is not more than about 280° C.

In the case of forming printed images with use of the thermal transfer recording material, printed images may be directly formed on a final object.

Alternatively, printed images may be previously formed on a sheet-like image-receiving body (receptor) and then the image-receiving body with the printed images formed is attached to a final object with a suitable means such as heat-resistant adhesive.

Various sheet-like articles can be used as the aforesaid sheet-like receptor. However, the sheet-like receptor disclosed in the applicant's prior Japanese Patent Application No. 141996/1994 is suitably used. The receptor comprises a foundation, an image-receiving layer provided on one side of the foundation and composed of a white pigment and an organic binder as essential components, and a heat-resistant pressure-sensitive adhesive layer provided on the other side of the foundation. The organic binder is phenoxy resin, or a mixture of phenoxy resin and saturated polyester resin.

Other examples of the sheet-like receptor are sheets of heat-resistant resins such as polyimide, cloths of glass fibers or ceramic fibers, sheets wherein the foregoing cloths are coated with or impregnated with a heat-resistant resin, glass or ceramic sheets, and metal sheets.

The printed images formed on an object with use of the thermal transfer recording material of the present invention are further substantially improved in the heat resistance, solvent resistance and scratch resistance by being subjected to a heat treatment. The heat treatment is preferably performed by heating the printed images in an atmosphere of 150° to 250° C. for 15 to 60 minutes. It is presumed that the epoxy resin contained in the printed images is cross-linked by such heat treatment, thereby improving the fastness of the printed images.

In the case of printed images formed on an article, such as printed wiring board or semiconductor, which is subjected to heating treatment equivalent to the aforesaid heat treatment in a later step, the heat treatment is not necessarily required.

The thermal transfer recording material of the present invention is especially advantageously used for forming printed images on articles which are subjected to a heating treatment at high temperatures of about 150° to about 280° C., such as printed wiring boards which are subjected to such heating treatment in production process and semiconductors which are subjected to such heating treatment in inspection process, because the recording material gives printed images having excellent heat resistance, solvent resistance and scratch resistance.

The present invention will be more fully described by way of Examples. It is to be understood that the present invention is not limited to the Examples, and various change and modifications may be made in the invention without departing from the spirit and scope thereof.

EXAMPLES 1-1 to 1-10 and Comparative Examples 1-1 to 1-3

A 5 μm-thick polyethylene terephthalate film was formed on one side thereof with a sticking-preventive layer composed of a silicone resin with a coating amount of 0.25 g/m$^2$. Onto the opposite side of the polyethylene terephthalate film with respect to the sticking-preventive layer was applied an ink coating liquid having the formula shown in Table 1-1, followed by drying to form a heat-meltable ink layer with a coating amount of 2 g/m$^2$, yielding a thermal transfer recording material.

TABLE 1-1

| | Ex. 1-1 | Ex. 1-2 | Ex. 1-3 | Ex. 1-4 | Ex. 1-5 | Ex. 1-6 | Ex. 1-7 | Ex. 1-8 | Ex. 1-9 | Ex. 1-10 | Com. Ex. 1-1 | Com. Ex. 1-2 | Com. Ex. 1-3 |
|---|---|---|---|---|---|---|---|---|---|---|---|---|---|
| Formula of ink coating liquid (%) | | | | | | | | | | | | | |
| Epikote 1031S*1 | 14 | 18 | 8 | 11 | 11 | 7 | 12.6 | 14 | 14 | 14 | | | 5 |
| Epikote 1003*2 | | | | 3 | | 7 | | | | | | 14 | 9 |
| Epikote 828*3 | | | | | 3 | | | | | | | | |
| Paraffin wax | | | | | | | | | | | 16 | | |
| Ethylene vinyl acetate copolymer*4 | | | | | | | 1.4 | | | | 2 | | |
| Carbon black | 6 | 2 | 12 | 6 | 6 | 6 | 6 | | | | 2 | 6 | 6 |
| Yellow pigment*5 | | | | | | | | 6 | | | | | |
| Magenta Pigment*6 | | | | | | | | | 6 | | | | |
| Cyan pigment*7 | | | | | | | | | | 6 | | | |
| Methyl ethyl ketone | 80 | 80 | 80 | 80 | 80 | 80 | 80 | 80 | 80 | 80 | | | 80 |
| Toluene | | | | | | | | | | | 16 | | |
| Isopropyl alcohol | | | | | | | | | | | 64 | | |
| Ethyl acetate | | | | | | | | | | | | 80 | |
| Softening point of vehicle (°C.) | 92 | 92 | 92 | 91 | 78 | 80 | 91 | 92 | 92 | 92 | 74 | 89 | 91 |

*1: TPETGE made by Yuka Shell Epoxy Kabushiki Kaisha, softening point: 92° C.
*2: BPADGE made by Yuka Shell Epoxy Kabushiki Kaisha, softening point: 89° C.
*3: BPADGE made by Yuka Shell Epoxy Kabushiki Kaisha, liquid
*4: Melt index: 2,500, softening point: 84° C.
*5: Sanyo Color Works, Ltd., C.I. Pig. No. Y-12
*6: Sanyo Color Works, Ltd., C.I. Pig. No. R-122
*7: Sanyo Color Works, Ltd., C.I. Pig. No. B-15-2

Each of the inks shown in Table 1-1 was evaluated for heat resistance.

Further, with use of each of the obtained thermal transfer recording materials, printing was performed and the resulting printed images were evaluated for solvent resistance, scratch resistance and transferability. The printing was performed using a thermal transfer type bar code printer (B-30 made by TEC Corp.) under the following conditions:

Applied energy: 25.8 mJ/mM$^2$

Printing speed: 2 inches/second

Platen pressure: "High"

Printing pattern: Checkered flag pattern

The results are shown in Table 1-2.

[Heat resistance]

About 10 mg of each ink after being evaporated to dryness and dried was accurately weighed out with an electronic scales. After being subjected to a heat treatment in an oven at 250° C. for an hour, the weight of the ink was again measured. The ink residue ratio defined by the following formula was determined to evaluate the heat resistance of the ink. When the ink residue ratio is not less than 80% , there is no problem in practical use.

$$\text{Ink residue ratio (\%)} = \frac{\text{Weight after heat treatment}}{\text{Weight before heat treatment}} \times 100$$

[Solvent resistance]

As a receptor, there was used an aluminum-deposited polyethylene terephthalate film having a pressure-sensitive adhesive layer on the aluminum-deposition layer side. Printed images (checkered flag pattern) formed on the surface of the polyethylene terephthalate film were rubbed ten times with a swab (cotton stick) impregnated with a solvent shown in Table 1-2. The solvent resistance of the printed images was evaluated according to the following criterion Evaluation Criterion A . . . The image is not removed at all.

B . . . The image is little removed.

C . . . The image is a little removed.

D . . . The image is appreciably removed.

The evaluation value "A" or "B" indicates that the printed images are practically usable.

[Scratch resistance]

With use of the same receptor employed in the solvent resistance test, printing was performed and the resulting printed images (checkered flag pattern) were subjected to the below-mentioned scratch resistance test. The scratch resistance of the printed images was evaluated according to the following criterion.

Test Conditions

Tester: Rub Tester made by Yasuda Seiki Seisakusho Ltd.

Rubbing material: Sand eraser

Load: 250 g/cm$^2$ Reciprocation number: 10

Evaluation Criterion

A . . . The image is not changed at all.

B . . . The image is little changed.

C . . . A very slight portion of the image is removed.

D . . . An appreciable portion of the image is removed.

E . . . The image is removed, resulting in disappearing.

The evaluation value "A", "B" or "C" indicates that the printed images are practically usable.

[Transferability]

As a receptor, there was used a 76 $\mu$m-thick polyimide film formed on one side thereof with a silicone resin type pressure-sensitive adhesive layer and on the other side thereof with a white coating layer having the following formula (coating amount: 28 g/m$^2$). Hereinafter, this receptor is referred to as "receptor A".

| Components | Parts by weight |
|---|---|
| Saturated polyester resin | 5 |
| Phenoxy resin | 11 |
| Titanium oxide | 29 |

Printing was performed to form printed images (checkered flag pattern) on the white coating layer of receptor A. The reflection optical density (OD value) of the solid-printed portion of the image was measured with a reflection densitometer (Macbeth RD 914) to evaluate the transferability. When the OD value is not less than 0.8, there is no problem in practical use.

TABLE 1-2

| | Ex. 1-1 | Ex. 1-2 | Ex. 1-3 | Ex. 1-4 | Ex. 1-5 | Ex. 1-6 | Ex. 1-7 | Ex. 1-8 | Ex. 1-9 | Ex. 1-10 | Com. Ex. 1-1 | Com. Ex. 1-2 | Com. Ex. 1-3 |
|---|---|---|---|---|---|---|---|---|---|---|---|---|---|
| Ink residue ratio (%) | 95 | 93 | 95 | 94 | 90 | 93 | 95 | 95 | 95 | 95 | 50 | 93 | 95 |
| Solvent resistance | | | | | | | | | | | | | |
| Ethanol | A | A | A | B | B | B | A | A | A | A | D | B | B |
| Kerosene | A | A | A | A | A | A | A | A | A | A | D | A | A |
| Gasoline | A | A | A | A | A | A | A | A | A | A | D | A | A |
| Toluene | B | B | B | B | B | B | B | B | B | B | D | B | B |
| Carbon tetrachloride | A | A | A | A | A | A | A | A | A | A | D | A | A |
| Scratch resistance | B | B | B | B | B | B | C | B | B | B | E | B | B |
| OD value | 1.90 | 1.70 | 1.78 | 1.75 | 1.70 | 1.40 | 1.80 | 2.05 | 2.08 | 2.00 | 1.85 | 0.70 | 0.78 |

With use of each of the thermal transfer recording materials obtained in Examples 1-1 to 1-10, printed images were formed on the white coating layer of receptor A by means of the same bar code printer as mentioned above under the same printing conditions. The receptor A bearing the printed images was placed in a drying oven (Model DX-58 made by Yamato Scientific Co., Ltd.) and heated at 200° C. for 60 minutes. With respect to the printed images thus subjected to the heat treatment, the solvent resistance, scratch resistance and transferability were evaluated in the same manner as described above. The results are shown in Table 1-3 .

TABLE 1-3

| | Ex. 1-1 | Ex. 1-2 | Ex. 1-3 | Ex. 1-4 | Ex. 1-5 | Ex. 1-6 | Ex. 1-7 | Ex. 1-8 | Ex. 1-9 | Ex. 1-10 |
|---|---|---|---|---|---|---|---|---|---|---|
| Solvent resistance | | | | | | | | | | |
| Ethanol | A | A | A | A | A | A | A | A | A | A |
| Kerosene | A | A | A | A | A | A | A | A | A | A |
| Gasoline | A | A | A | A | A | A | A | A | A | A |

TABLE 1-3-continued

| | Ex. 1-1 | Ex. 1-2 | Ex. 1-3 | Ex. 1-4 | Ex. 1-5 | Ex. 1-6 | Ex. 1-7 | Ex. 1-8 | Ex. 1-9 | Ex. 1-10 |
|---|---|---|---|---|---|---|---|---|---|---|
| Toluene | A | A | A | A | A | A | A | A | A | A |
| Carbon tetrachloride | A | A | A | A | A | A | A | A | A | A |
| Scratch resistance | A | A | A | A | A | A | A | A | A | A |
| OD value | 1.90 | 1.70 | 1.78 | 1.75 | 1.70 | 1.40 | 1.80 | 2.05 | 2.08 | 2.00 |

EXAMPLE 1-11 and 1-12 and Comparative Example 1-4

Onto the front side (the opposite side with respect to the sticking-preventive layer) of the polyethylene terephthalate film was applied a wax coating liquid having the formula shown in Table 1-4 , followed by drying to form a wax layer with a coating amount of 0.4 g/m$^2$. Onto the wax layer was applied an ink coating liquid having the same formula as that used in Example 1-1 , followed by drying to form a heat-meltable ink layer with a coating amount of 2 g/m$^2$, yielding a thermal transfer recording material.

The printed images obtained with use of each of the thus obtained thermal transfer recording materials, which printed images were not subjected to the heat treatment, were evaluated for the scratch resistance in the same manner as in Examples 1-1 to 1-11 . The results thereof are shown in Table 1-4 .

TABLE 1-4

| | Ex. 1-11 | Ex. 1-12 | Com. Ex. 1-4 |
|---|---|---|---|
| Formula of wax coating liquid (%) | | | |
| Carnauba wax emulsion*1 (solid content: 30%) | 33 | | |
| Polyethylene wax emulsion*2 (solid content: 40%) | | 25 | |
| Paraffin wax emulsion*3 (solid content: 40%) | | | 25 |
| Methanol | 67 | 75 | 75 |
| Penetration of wax layer | less than 1 | less than 1 | 12 |
| Scratch resistance | A | A | E |

*1: Melting point: 84° C.
*2: Melting point: 102° C.
*3: Melting point: 74° C.

As is apparent from Table 1-4, the thermal transfer recording materials of Examples 1-11 and 1-12 wherein a wax layer having a penetration of not more than 1 is provided is further improved in the scratch resistance as compared to the thermal transfer recording material of Example 1-1 . In contrast thereto, the thermal transfer recording material of Comparative Example 1-4 is rather degraded in the scratch resistance by providing the wax layer. The reason therefor is presumed that since the penetration of the used wax layer exceeds 1 (penetration: 12), the ink composed of the epoxy resin is plasticized with the wax when heat is applied in the thermal transfer.

Example 1-13 and Comparative Example 1-5

A 5 μm-thick polyethylene terephthalate film was formed on one side thereof with a sticking-preventive layer composed of a silicone resin with a coating amount of 0.25 g/m$^2$. Onto the opposite side of the polyethylene terephthalate film with respect to the sticking-preventive layer were applied coating liquids for respective color inks shown in Table 1-5 , followed by drying to obtain a thermal transfer recording material wherein respective color heat-meltable ink layers each having a coating amount of 2 g/m$^2$ were arranged as shown in FIG. 1.

TABLE 1-5

| | Ex. 1-13 | | | Com. Ex. 1-5 | | |
|---|---|---|---|---|---|---|
| | Yellow | Magenta | Cyan | Yellow | Magenta | Cyan |
| Formula of ink coating liquid (%) | | | | | | |
| Epikote 1031S | 14 | 14 | 14 | | | |
| Paraffin wax | | | | 12.5 | 12.5 | 12.5 |
| Ethylene-vinyl acetate copolymer*1 | | | | 1.5 | 1.5 | 1.5 |
| Yellow pigment*2 | 6 | | | 6 | | |
| Magenta pigment*3 | | 6 | | | 6 | |
| Cyan pigment*4 | | | 6 | | | 6 |
| Methyl ethyl ketone | 80 | 80 | 80 | | | |
| Toluene | | | | 16 | 16 | 16 |
| Isopropyl alcohol | | | | 64 | 64 | 64 |
| Softening point of vehicle (°C.) | 92 | 92 | 92 | 74 | 74 | 74 |

*1: Melt index: 2,500, softening point: 84° C.
*2: Sanyo Color Works, Ltd., C.I. Pig. No. Y-12
*3: Sanyo Color Works, Ltd., C.I. Pig. No. R-122
*4: Sanyo Color Works, Ltd., C.I. Pig. No. B-15-2

With use of each of the obtained thermal transfer recording materials, superimposing-printing on one dot basis was performed in the order of yellow, magenta and cyan under the printing conditions mentioned below. With respect to the yellow ink dots formed on the receptor, the magenta ink dots superimposed respectively on the yellow ink dots and the cyan ink dots superimposed respectively on the magenta ink dots, the ratio of the area of the ink dot to the area (0.0154 $mm^2$) of one heat-generating element (hereinafter referred to as "dot-transfer ratio") was determined. The dot-transfer ratio is an average value of those for 193 dots. Superimposing of ink dots is advantageously performed as the dot-transfer ratio is nearer to 1. The results are shown in Table 1-6.

[Printing Conditions]

Thermal transfer printer: B-30 made by TEC Ccrp.

Applied energy: 19.6 $mJ/mm^2$

Printing speed: 2 inches/second

Platen pressure: "High"

Receptor: Aluminum-deposited polyethylene terephthalate film having a pressure-sensitive adhesive layer on the aluminum deposition layer side Evaluation Criterion A . . . Dot-transfer ratio: 0.95 to 1.05

B . . . Dot-transfer ratio: not less than 0.90 and less than 0.95

C . . . Dot-transfer ratio: less than 0.90

TABLE 1-6

| | Dot-transfer ratio | | |
|---|---|---|---|
| | Yellow ink dot | Magenta ink dot | Cyan ink dot |
| Ex. 1-13 | A | A | A |
| Com. Ex. 1-5 | A | C | C |

As is apparent from Table 1-6, when different color ink dots are superimposed one on another with use of the thermal transfer recording material for color image formation according to the present invention, favorable superimposing quality can be achieved.

EXAMPLE 2-1 to 2-7 and Comparative Examples 2-1 to 2-3

A 5 $\mu$m-thick polyethylene terephthalate film was formed on one side thereof with a sticking-preventive layer composed of a silicone resin with a coating amount of 0.25 $g/m^2$. Onto the opposite side of the polyethylene terephthalate film with respect to the sticking-preventive layer was applied an ink coating liquid having the formula shown in Table 2-1 , followed by drying to form a heat-meltable ink layer with a coating amount of 2 $g/m^2$, yielding a thermal transfer recording material.

TABLE 2-1

| | Ex. 2-1 | Ex. 2-2 | Ex. 2-3 | Ex. 2-4 | Ex. 2-5 | Ex. 2-6 | Ex. 2-7 | Com. Ex. 2-1 | Com. Ex. 2-2 | Com. Ex. 2-3 |
|---|---|---|---|---|---|---|---|---|---|---|
| Formula of ink coating liquid (%) | | | | | | | | | | |
| Araidite ECN1280*1 | 14 | 18 | 8 | 11 | 11 | 7 | 12.6 | | | 5 |
| Epikote 1003*2 | | | | 3 | | 7 | | | 14 | 9 |
| Epikote 828*3 | | | | | 3 | | | | | |
| Paraffin wax | | | | | | | | 16 | | |
| Ethylene-vinyl acetate copolymer*4 | | | | | | | 1.4 | 2 | | |
| Carbon black | 6 | 2 | 12 | 6 | 6 | 6 | 6 | 2 | 6 | 6 |
| Methyl ethyl ketone | 80 | 80 | 80 | 80 | 80 | 80 | 80 | | | 80 |
| Toluene | | | | | | | | 16 | | |
| Isopropyl alcohol | | | | | | | | 64 | | |
| Ethyl acetate | | | | | | | | | 80 | |
| Softening point of vehicle (°C.) | 80 | 80 | 80 | 82 | 67 | 85 | 80 | 74 | 89 | 86 |

*1: o-Cresol novolak polyglycidyl ether made by Asahi-CIBA Limited, softening point: 80° C.
*2: BPADGE made by Yuka Shell Epoxy Kabushiki Kaisha, softening point: 89° C.
*3: BPADGE made by Yuka Shell Epoxy Kabushiki Kaisha, liquid
*4: Melt index: 2,500, softening point: 84° C.

Each of the inks shown in Table 2-1 was evaluated for the heat resistance in the same manner as in Examples 1-1 to 1-10 . Further, each of the thus obtained thermal transfer recording materials was evaluated for the solvent resistance and scratch resistance of printed images and the transferability of the ink layer in the same manner as in Examples 1-1 to 1-10 . The results thereof are shown in Table 2-2.

TABLE 2-2

| | Ex. 2-1 | Ex. 2-2 | Ex. 2-3 | Ex. 2-4 | Ex. 2-5 | Ex. 2-6 | Ex. 2-7 | Com. Ex. 2-1 | Com. Ex. 2-2 | Com. Ex. 2-3 |
|---|---|---|---|---|---|---|---|---|---|---|
| Ink residue ratio (%) | 95 | 94 | 95 | 93 | 90 | 93 | 95 | 50 | 93 | 95 |
| Solvent resistance | | | | | | | | | | |
| Ethanol | A | A | A | B | B | B | A | D | B | B |
| Kerosene | A | A | A | A | A | A | A | D | A | A |
| Gasoline | A | A | A | A | A | A | A | D | A | A |
| Carbon tetrachloride | A | A | A | A | A | A | A | D | A | A |
| Sratch resistance | B | B | B | B | B | B | C | E | B | B |
| OD value | 2.32 | 2.31 | 2.28 | 1.75 | 1.78 | 1.40 | 2.10 | 1.85 | 0.70 | 0.73 |

With use of each of the thermal transfer recording materials obtained in Examples 2-1 to 2-7 , printed images were formed on the white coating layer of receptor A by means of the same bar code printer as used in Examples 1-1 to 1-10 under the same printing conditions. The receptor A bearing the printed images was placed in a drying oven (Model DX-58 made by Yamato Scientific Co., Ltd.) and heated at 200° C. for 60 minutes. With respect to the printed images thus subjected to the heat treatment, the solvent resistance, scratch resistance and transferability were evaluated in the same manner as in Examples 1-1 to 1-10 . The results are shown in Table 2-3 .

TABLE 2-3

| | Ex. 2-1 | Ex. 2-2 | Ex. 2-3 | Ex. 2-4 | Ex. 2-5 | Ex. 2-6 | Ex. 2-7 |
|---|---|---|---|---|---|---|---|
| Solvent resistance | | | | | | | |
| Ethanol | A | A | A | A | A | A | A |
| Kerosene | A | A | A | A | A | A | A |
| Gasoline | A | A | A | A | A | A | A |
| Carbon tetrachloride | A | A | A | A | A | A | A |
| Scratch resistance | A | A | A | A | A | A | A |
| OD value | 2.32 | 2.31 | 2.28 | 1.75 | 1.78 | 1.40 | 2.10 |

EXAMPLES 2-8 and 2-9 and Comparative Example 2-4

Onto the front side (the opposite side with respect to the sticking-preventive latter) of the polyethylene terephthalate film was applied a wax coating liquid having the formula shown in Table 2-4 , followed by drying to form a wax layer with a coating amount of 0.4 g/m$^2$. Onto the wax coating layer was applied an ink coating liquid having the same formula as that used in Example 2-1 , followed by drying to form a heat-meltable ink layer with a coating amount of 2 g/m$^2$, yielding a thermal transfer recording material.

The printed images obtained with use of each of the thus obtained thermal transfer recording materials, which printed images were not subjected to the heat treatment, were evaluated for the scratch resistance in the same manner as in Examples 1-1 to 1-10 . The results thereof are shown in Table 2-4 .

TABLE 2-4

| | Ex. 2-8 | Ex. 2-9 | Com. Ex. 2-4 |
|---|---|---|---|
| Formula of wax coating liquid (%) | | | |
| Carnauba wax emulsion*1 (solid content: 30%) | 33 | | |

TABLE 2-4-continued

| | Ex. 2-8 | Ex. 2-9 | Com. Ex. 2-4 |
|---|---|---|---|
| Polyethylene wax emulsion*2 (solid content: 40%) | | 25 | |
| Paraffin wax emulsion*3 (solid content: 40%) | | | 25 |
| Methanol | 67 | 75 | 75 |
| Penetration of wax layer | less than 1 | less than 1 | 12 |
| Scratch resistance | A | A | E |

*1: Melting point: 84° C.
*2: Melting point: 102° C.
*3: Melting point: 74° C.

As is apparent from Table 2-4 , the thermal transfer recording, materials of Examples 2-8 and 2-9 wherein a wax layer having a penetration of not more than 1 is provided is further improved in the scratch resistance as compared to the thermal transfer recording material of Example 2-1 . In contrast thereto, the thermal transfer recording material of Comparative Example 2-4 is rather degraded in the scratch resistance by providing the wax layer. The reason therefor is presumed that since the penetration of the used wax layer exceeds 1 (penetration: 12), the ink composed of the epoxy resin is plasticized with the wax when heat is applied in the thermal transfer.

EXAMPLES 2-10 and Comparative Example 2-5

A 5 $\mu$m-thick polyethylene terephthalate film was formed on one side thereof with a stick-preventive layer composed of a silicone resin with a coating amount of 0.25 g/m$^2$. Onto the opposite side of the polyethylene terephthalate film with respect to the sticking-preventive layer were applied coating liquids for respective color inks shown in Table 2-5 , followed by drying to obtain a thermal transfer recording material wherein respective color heat-meltable ink layers each having a coating amount of 2 g/m$^2$ were arranged as shown in FIG. 1.

TABLE 2-5

| | Ex. 2-10 | | | Com. Ex. 2-5 | | |
|---|---|---|---|---|---|---|
| | Yellow | Magenta | Cyan | Yellow | Magenta | Cyan |
| Formula of ink coating liquid (%) | | | | | | |
| Araldite ECN 1280 | 14 | 14 | 14 | | | |
| Paraffin wax | | | | 12.5 | 12.5 | 12.5 |
| Ethylene-vinyl acetate copolymer*1 | | | | 1.5 | 1.5 | 1.5 |
| Yellow pigment*2 | 6 | | | 6 | | |
| Magenta pigment*3 | | 6 | | | 6 | |
| Cyan pigment*4 | | | 6 | | | 6 |
| Methyl ethyl ketone | 80 | 80 | 80 | | | |
| Toluene | | | | 16 | 16 | 16 |
| Isopropyl alcohol | | | | 64 | 64 | 64 |
| Softening point of vehicle (°C.) | 80 | 80 | 80 | 74 | 74 | 74 |

*1: Melt index: 2,500, softening point: 84° C.
*2: Sanyo Color Works, Ltd., C.I. Pig. No. Y-12
*3: Sanyo Color Works, Ltd., C.I. Pig. No. R-122
*4: Sanyo Color Works, Ltd., C.I. Pig. No. B-15-2

With respect to the thus obtained thermal transfer recording materials, the dot-transfer ratio was determined in the same manner as in Example 1-13 and Comparative Example 1-5 . The results thereof are shown in Table 2-6.

TABLE 2-6

| | Dot-transfer ratio | | |
|---|---|---|---|
| | Yellow ink dot | Magenta ink dot | Cyan ink dot |
| Ex. 2-10 | A | A | A |
| Com. Ex. 2-5 | A | C | C |

As is apparent from Table 2-6, when different color ink dots are superimposed one on another with use of the thermal transfer recording material for color image formation according to the present invention, favorable superimposing quality can be achieved.

EXAMPLES 3-1 to 3-11 and Comparative Examples 3-1 to 3-4

A 5 $\mu$m -thick polyethylene terephthalate film was formed on one side thereof with a sticking-preventive layer composed of a silicone resin with a coating amount of 0.25 g/m$^2$. Onto the opposite side of the polyethylene terephthalate film with respect to the sticking-preventive layer was applied an ink coating liquid having the formula shown in Table 3-1, followed by drying to form a heat-meltable ink layer with a coating amount: of 2 g/m$^2$, yielding a thermal transfer recording material.

TABLE 3-1

| | Ex. 3-1 | Ex. 3-2 | Ex. 3-3 | Ex. 3-4 | Ex. 3-5 | Ex. 3-6 | Ex. 3-7 | Ex. 3-8 | Ex. 3-9 | Ex. 3-10 | Ex. 3-11 | Com. Ex. 3-1 | Com. Ex. 3-2 | Com. Ex. 3-3 | Com. Ex. 3-4 |
|---|---|---|---|---|---|---|---|---|---|---|---|---|---|---|---|
| Formula of ink coating liquid (%) | | | | | | | | | | | | | | | |
| Epikote 4007P*1 | 14 | 11 | 11 | 7 | 12.6 | 13.3 | | | | | | | | 5 | |
| BPFDGE*2 | | | | | | | 14 | | | 11.9 | | | | | 10.5 |
| BPFDGE*3 | | | | | | | | 11 | | | | | | | |
| BPFDGE*4 | | | | | | | | | 11 | | | | | | |
| BPFDGE*5 | | | | | | | | | | | 14 | | | | |
| Epikote 1003*6 | | 3 | | 7 | | | | | 3 | | | | 14 | 9 | |
| Epikote 828*7 | | | 3 | | | | | | | | | | | | |
| Epikote 1031S*8 | | | | | | | | 3 | | | | | | | |
| Paraffin wax | | | | | | | | | | | | 16 | | | |
| Ethylene-vinyl acetate copolymer*9 | | | | | 1.4 | 0.7 | | | | 2.1 | | 2 | | | 3.5 |
| Carbon black | 6 | 6 | 6 | 6 | 6 | 6 | 6 | 6 | 6 | 6 | 6 | 2 | 6 | 6 | 6 |
| Methyl ethyl ketone | 80 | 80 | 80 | 80 | 80 | 80 | 80 | 80 | 80 | 80 | 80 | | | 80 | 80 |
| Toluene | | | | | | | | | | | | 16 | | | |
| Isopropyl alcohol | | | | | | | | | | | | 64 | | | |
| Ethyl acetate | | | | | | | | | | | | | 80 | | |
| Softening point of vehicle (°C.) | 109 | 105 | 90 | 99 | 107 | 108 | 95 | 98 | 91 | 93 | 89.5 | 74 | 89 | 96 | 92 |

*1: BPFDGE made by Yuka Shell Epoxy Kabushiki Kaisha in which the content of BPFDGE of formula (V) wherein ml = 0 is 0.85%, softening point: 109° C.
*2: BPFDGE in which the content of BPFDGE of formula (V) wherein ml = 0 is 0.44%, softening point: 95° C.
*3: BPFDGE in which the content of BPFDGE of formula (V) wherein ml = 0 is 0.25%, softening point: 100° C.
*4: BPFDGE in which the content of BPFDGE of formula (V) wherein ml = 0 is 1.95%, softening point: 92° C.
*5: BPFDGE in which the content of BPFDGE of formula (V) wherein ml = 0 is 2.65%, softening point: 89.5° C.
*6: BPADGE made by Yuka Shell Epoxy Kabushiki Kaisha, softening point: 89° C.
*7: BPADGE made by Yuka Shell Epoxy Kabushiki Kaisha, liquid
*8: TPETGE made by Yuka Shell Epoxy Kabushiki Kaiha
*9: Nippon UNICAR COMPANY LIMITED, melt index: 2,500, softening point: 84° C.

Each of the inks shown in Table 3-1 was evaluated for the heat resistance in the same manner as in Examples 1-1 to 1-10 . Further, each of the thus obtained thermal transfer recording materials was evaluated for the solvent resistance and scratch resistances of printed images and the transferability of the ink layer in the same manner as in Examples 1-1 to 1-10 . The results thereof are shown in Table 3-2.

TABLE 3-2

| | Ex. 3-1 | Ex. 3-2 | Ex. 3-3 | Ex. 3-4 | Ex. 3-5 | Ex. 3-6 | Ex. 3-7 | Ex. 3-8 | Ex. 3-9 | Ex. 3-10 | Ex. 3-11 | Com. Ex. 3-1 | Com. Ex. 3-2 | Com. Ex. 3-3 | Com. Ex. 3-4 |
|---|---|---|---|---|---|---|---|---|---|---|---|---|---|---|---|
| Ink residue ratio (%) | 96 | 95 | 93 | 94 | 94 | 95 | 96 | 93 | 93 | 95 | 95 | 50 | 93 | 95 | 93 |
| Solvent resistance | | | | | | | | | | | | | | | |
| Kerosene | A | B | B | B | A | A | A | A | A | A | A | D | B | B | B |
| Gasoline | A | A | A | A | A | A | A | A | A | A | B | D | A | A | B |
| Ethanol | A | A | A | A | A | A | A | A | A | A | B | D | A | A | A |
| Carbon tetrachloride | A | A | A | A | A | A | A | A | A | A | B | D | A | A | B |
| Toluene | B | B | B | B | B | B | B | B | B | B | C | D | B | B | C |
| Scratch resistance | B | B | B | B | B | B | B | B | B | B | B | E | B | B | D |
| OD value | 1.65 | 1.57 | 1.63 | 1.20 | 1.55 | 1.58 | 1.88 | 1.04 | 1.99 | 1.90 | 2.00 | 1.85 | 0.70 | 0.75 | 1.63 |

With use of each of the thermal transfer recording materials obtained in Examples 3-1 to 3-11, printed images were formed on the white coating layer of receptor A by means of the same bar code printer as used in Examples 1-1 to 1-10 under the same printing conditions. The receptor A bearing the printed images was placed in a drying oven (Model DX-58 made by Yamato Scientific Co., Ltd.) and heated at 200° C. for 60 minutes. With respect to the printed images thus subjected to the heat treatment, the solvent resistance, scratch resistance and transferability were evaluated in the same manner as in Examples 1-1 to 1-10 . The results are shown in Table 3-3.

TABLE 3-3

| | Ex. 3-1 | Ex. 3-2 | Ex. 3-3 | Ex. 3-4 | Ex. 3-5 | Ex. 3-6 | Ex. 3-7 | Ex. 3-8 | Ex. 3-9 | Ex. 3-10 | Ex. 3-11 |
|---|---|---|---|---|---|---|---|---|---|---|---|
| Solvent resistance | | | | | | | | | | | |
| Kerosene | A | A | A | A | A | A | A | A | A | A | A |
| Gasoline | A | A | A | A | A | A | A | A | A | A | A |
| Ethanol | A | A | A | A | A | A | A | A | A | A | A |
| Carbon tetrachloride | A | A | A | A | A | A | A | A | A | A | A |
| Toluene | A | A | A | A | A | A | A | A | A | A | A |
| Scratch resistance | A | A | A | A | A | A | A | A | A | A | A |
| OD value | 1.65 | 1.57 | 1.63 | 1.20 | 1.55 | 1.58 | 1.88 | 1.04 | 1.99 | 1.90 | 2.00 |

EXAMPLES 3-12 to 3-15 and Comparative Examples 3-5 and 3-6

Onto the front side (the opposite side with respect to the sticking-preventive layer) of the polyethylene terephthalate film was applied a wax coating liquid having the formula shown in Table 3-4, followed by drying to form a wax layer with a coating amount of 0.4 g/m$^2$. Onto the wax layer was applied an ink coating liquid having the same formula as that used in Example 3-1, followed by drying to form a heat-meltable ink layer with a coating amount of 2 g/m$^2$, yielding a thermal transfer recording material (Examples 3-12 and 3-13 , and Comparative Example 3-5 ). Onto the wax layer formed on the polyethylene terephthalate film in the same manner as mentioned above was applied an ink coating liquid having the same formula as that used in Example 3-7, followed by drying to form a heat-meltable ink layer with a coating amount of 2 g/m$^2$, yielding a thermal transfer recording material (Examples 3-14 and 3-15, and Comparative Example 3-6 ).

The printed images obtained with use of each of the thus obtained thermal transfer recording materials, which printed images were not subjected to the heat treatment, were evaluated for the solvent resistance and scratch resistance in the same manner as in Examples 1-1 to 1-10 . The results thereof are shown in Table 3-5 .

TABLE 3-4

| | Ex. 3-12 | Ex. 3-13 | Ex. 3-14 | Ex. 3-15 | Com. Ex. 3-5 | Com. Ex. 3-6 |
|---|---|---|---|---|---|---|
| Formula of wax coating liquid (%) | | | | | | |
| Carnauba wax emulsion*1 (solid content: 30%) | 33 | | 33 | | | |
| Polyethylene wax emulsion*2 (solid content: 40%) | | 25 | | 25 | | |

TABLE 3-4-continued

| | Ex. 3-12 | Ex. 3-13 | Ex. 3-14 | Ex. 3-15 | Com. Ex. 3-5 | Com. Ex. 3-6 |
|---|---|---|---|---|---|---|
| Paraffin wax emulsion*3 (solid content: 40%) | | | | | 33 | 33 |
| Methanol | 67 | 75 | 67 | 75 | 67 | 67 |
| Penetration of wax layer | less than 1 | less than 1 | less than 1 | less than 1 | 12 | 12 |

*1: Melting point: 84° C.
*2: Melting point: 102° C.
*3: Melting point: 74° C.

TABLE 3-5

| | Ex. 3-12 | Ex. 3-13 | Ex. 3-14 | Ex. 3-15 | Com. Ex. 3-5 | Com. Ex. 3-6 |
|---|---|---|---|---|---|---|
| Ink layer | Ex. 3-1 | Ex. 3-1 | Ex. 3-7 | Ex. 3-7 | Ex. 3-1 | Ex. 3-7 |
| Solvent resistance | | | | | | |
| Kerosene | A | A | A | A | C | C |
| Gasoline | A | A | A | A | C | C |
| Ethanol | A | A | A | A | C | C |
| Carbon tetrachloride | A | A | A | A | C | C |
| Toluene | A | A | A | A | D | D |
| Scratch resistance | A | A | A | A | D | E |

As is apparent from Table 3-5 , the thermal transfer recording materials of Examples 3-12 and 3-13 wherein a wax layer having a penetration of not more than 1 is provided is further improved in the scratch resistance and toluene resistance as compared to the thermal transfer recording material of Example 3-1, and the thermal transfer recording materials of Examples 3-14 and 3-15 wherein a wax layer having a penetration of not more than 1 is provided is further improved in the scratch resistance and toluene resistance as compared to the thermal transfer recording material of Example 3-7 . In contrast thereto, the thermal transfer recording material of Comparative Examples 3-5 and 3-6 are rather degraded in the scratch resistance and toluene resistance by providing the wax layer. The reason therefor is presumed that since the penetration of the used wax layer exceeds 1 (penetration: 12), the ink composed of the epoxy resin is plasticized with the wax when heat is applied in the thermal transfer.

EXAMPLE 3-16 and Comparative Example 3-7

A 5 μm-thick polyethylene terephthalate film was formed on one side thereof with a sticking-preventive layer composed of a silicone resin with a coating amount of 0.25 g/m$^2$. Onto the opposite side of the polyethylene terephthalate film with respect to the sticking-preventive layer were applied coating liquids for respective color inks shown in Table 3-6 , followed by drying to obtain a thermal transfer recording material wherein respective color heat-meltable ink layers each having a coating amount of 2 g/m$^2$ were arranged as shown in FIG. 1.

TABLE 3-6

| | Ex. 3-16 | | | Com. Ex. 3-7 | | |
|---|---|---|---|---|---|---|
| | Yellow | Magenta | Cyan | Yellow | Magenta | Cyan |
| Formula of ink coating liquid (%) | | | | | | |
| Epikote 4007P | 14 | 14 | 14 | | | |
| Paraffin wax | | | | 12.5 | 12.5 | 12.5 |
| Ethylene-vinyl acetate copolymer*1 | | | | 1.5 | 1.5 | 1.5 |
| Yellow pigment*2 | 6 | | | 6 | | |
| Magenta pigment*3 | | 6 | | | 6 | |
| Cyan pigment*4 | | | 6 | | | 6 |
| Methyl ethyl ketone | 80 | 80 | 80 | | | |
| Toluene | | | | 16 | 16 | 16 |
| Isopropyl alcohol | | | | 64 | 64 | 64 |
| Softening point of vehicle (°C.) | 109 | 109 | 109 | 74 | 74 | 74 |

*1: Melt index: 2,500, softening point: 84° C.
*2: Sanyo Color Works, Ltd., C.I. Pig. No. Y-12
*3: Sanyo Color Works, Ltd., C.I. Pig. No. R-122
*4: Sanyo Color Works, Ltd., C.I. Pig. No. B-15-2

With respect to the thus obtained thermal Transfer recording materials, the dot-transfer ratio was determined in the same manner as in Example 1-13 and Comparative Example 1-5 . The results thereof are shown in Table 3-7.

TABLE 3-7

| | Dot-transfer ratio | | |
|---|---|---|---|
| | Yellow ink dot | Magenta ink dot | Cyan ink dot |
| Ex. 3-16 | A | A | A |
| Com. Ex. 3-7 | A | C | C |

As is apparent from Table 3-7 , when different color ink dots are superimposed one on another with use of the thermal transfer recording material for color image formation according to the present invention, favorable superimposing quality can be achieved.

EXAMPLES 4-1 to 4-6 and Comparative Examples 4-1 to 4-3

A 5 $\mu$m-thick polyethylene terephthalate film was formed on one side thereof with a sticking-preventive layer composed of a silicone resin with a coating amount of 0.25 g/m$^2$. Onto the opposite side of the polyethylene terephthalate film with respect to the sticking-preventive layer was applied an ink coating liquid having the formula shown in Table 4-1 , followed by drying to form a heat-meltable ink layer with a coating amount of 2 g/m$^2$, yielding a thermal transfer recording material.

TABLE 4-1

| | Ex. 4-1 | Ex. 4-2 | Ex. 4-3 | Ex. 4-4 | Ex. 4-5 | Ex. 4-6 | Com. Ex. 4-1 | Com. Ex. 4-2 | Com. Ex. 4-3 |
|---|---|---|---|---|---|---|---|---|---|
| Formula of ink coating liquid (%) | | | | | | | | | |
| Epikote 1003*1 | 14 | 14 | 14 | 11.9 | 13.3 | | 14 | 9.8 | |
| Epikote 4003P*2 | | | | | | 14 | | | |
| Paraffin wax | | | | | | | | | 16 |
| Ethylene-vinyl acetate copolymer*3 | | | | 2.1 | 0.7 | | | 4.2 | 2 |
| Printex 140V*4 | 6 | | | 6 | 6 | 6 | | 6 | 6 |
| MA 600*5 | | 6 | | | | | | | |
| Special Black 100*6 | | | 6 | | | | | | |
| #850*7 | | | | | | | 6 | | |
| Methyl ethyl ketone | 80 | 80 | 80 | 80 | 80 | 80 | 80 | 80 | |
| Toluene | | | | | | | | | 16 |
| Isopropyl alcohol | | | | | | | | | 64 |

*1: BPADGE made by Yuka Shell Epoxy Kabushiki Kaisha, softening point: 89° C.
*2: BPFDGE made by Yuka Shell Epoxy Kabushiki Kaisha, softening point: 76° C.
*3: Melt index: 2,500, softening point: 84° C.
*4: Carbon black made by Degussa AG. oil absorption: 110
*5: Carbon black made by Mitsubishi Kasei Corporation, oil absorption: 130
*6: Carbon black made by Degussa AG., oil absorption: 94
*7: Carbon black made by Mitsubishi Kasei Corporation, oil absorption: 78

Each of the inks shown in Table 4-1 was evaluated for the heat resistance in the same manner as in Examples 1-1 to 1-10 . Further, each of the thus obtained thermal transfer recording materials was evaluated for the solvent resistance and scratch resistance of printed images and the transferability of the ink layer in the same manner as in Examples 1-1 to 1-10 . The results thereof are shown in Table 4-2.

TABLE 4-2

| | Ex. 4-1 | Ex. 4-2 | Ex. 4-3 | Ex. 4-4 | Ex. 4-5 | Ex. 4-6 | Com. Ex. 4-1 | Com. Ex. 4-2 | Com. Ex. 4-3 |
|---|---|---|---|---|---|---|---|---|---|
| Ink residue ratio (%) | 93 | 93 | 92 | 90 | 91 | 93 | 93 | 93 | 50 |
| Solvent resistance | | | | | | | | | |
| Kerosene | A | A | A | A | A | A | A | A | D |
| Gasoline | A | A | A | A | A | A | A | A | D |
| Ethanol | B | B | B | B | B | B | B | B | D |
| Carbon tetrachloride | A | A | A | A | A | A | A | A | D |
| Scratch resistance | B | B | B | B | B | B | B | D | E |
| OD value | 2.20 | 2.10 | 2.05 | 1.80 | 1.93 | 2.10 | 0.70 | 1.60 | 1.85 |

With use of each of the thermal transfer recording materials obtained in Examples 4-1 to 4-6 , printed images were formed on the white coating layer of receptor A by means of the same bar code printer as used in Examples 1-1 to 1-10 under the same printing conditions. The receptor A bearing the printed images was placed in a drying oven (Model DX-58 made by Yamato Scientific Co., Ltd.) and heated at 200° C. for 60 minutes. With respect to the printed images thus subjected to the heat treatment, the solvent resistance, scratch resistance and transferability were evaluated in the same manner as in Examples 1-1 to 1-10 . The results are shown in Table 4-3 .

TABLE 4-3

| | Ex. 4-1 | Ex. 4-2 | Ex. 4-3 | Ex. 4-4 | Ex. 4-5 | Ex. 4-6 |
|---|---|---|---|---|---|---|
| Solvent resistance | | | | | | |
| Kerosene | A | A | A | A | A | A |
| Gasoline | A | A | A | A | A | A |
| Ethanol | A | A | A | A | A | A |
| Carbon tetrachloride | A | A | A | A | A | A |
| Scratch resistance | A | A | A | A | A | A |
| OD value | 2.20 | 2.10 | 2.05 | 1.80 | 1.93 | 2.10 |

EXAMPLES 4-7 and 4-8 and Comparative Example 4-4

Onto the front side (the opposite side with respect to the sticking-preventive layer) of the polyethylene terephthalate film was applied a wax coating liquid having the formula shown in Table 4-4 , followed by drying to form a wax layer with a coating amount of 0.4 g/m$^2$. Onto the wax layer was applied an ink coating liquid having the same formula as that used in Example 4-1 , followed by drying to form a heat-meltable ink layer with a coating amount of 2 g/m$^2$, yielding a thermal transfer recording material.

The printed images obtained with use of each of the thus obtained thermal transfer recording materials, which printed images were not subjected to the heat treatment, were evaluated for the solvent resistance and scratch resistance in the same manner as in Examples 1-1 to 1-10 . The results thereof are shown in Table 4-4 .

TABLE 4-4

| | Ex. 4-7 | Ex. 4-8 | Com. Ex. 4-4 |
|---|---|---|---|
| Formula of wax coating liquid (%) | | | |
| Carnauba wax emulsion*1 (solid content: 30%) | 33 | | |

TABLE 4-4-continued

| | Ex. 4-7 | Ex. 4-8 | Com. Ex. 4-4 |
|---|---|---|---|
| Polyethylene wax emulsion*2 (solid content: 40%) | | 25 | |
| Paraffin wax emulsion*3 (solid content: 40%) | | | 25 |
| Methanol | 67 | 75 | 75 |
| Penetration of wax layer | less than 1 | less than 1 | 12 |
| Solvent resistance | A | A | D |
| Kerosene | A | A | D |
| Gasoline | A | A | D |
| Ethanol | A | A | D |
| Carbon tetrachloride | A | A | D |
| Scratch resistance | A | A | D |

*1: Melting point: 84° C.
*2: Melting point: 102° C.
*3: Melting point: 74° C.

As is apparent from Table 4-4 , the thermal transfer recording materials of Examples 4-7 and 4-8 wherein a wax layer having a penetration of not more than 1 is provided is further improved in the scratch resistance and ethanol resistance as compared to the thermal transfer recording material of Example 4-1 . In contrast thereto, the thermal transfer recording material of Comparative Example 4-4 is rather degraded in the scratch resistance and solvent resistance by providing the wax layer. The reason therefor is presumed that since the penetration of the used wax layer exceeds 1 (penetration: 12), the ink composed of the epoxy resin is plasticized with the wax when heat is applied in the thermal transfer.

In addition to the materials and ingredients used in the Examples, other materials and ingredients can be used in Examples as set forth in the specification to obtain substantially the same results.

What we claim is:

1. A thermal transfer recording material comprising a foundation and a heat-meltable ink layer comprising a vehicle and a pigment provided on the foundation, the vehicle comprising not less than 85% by weight of an epoxy resin, the epoxy resin comprising not less than 50% by weight of at least one of bisphenol F diglycidyl ether and a bromide thereof, wherein the bisphenol F diglycidyl ether is represented by formula (V):

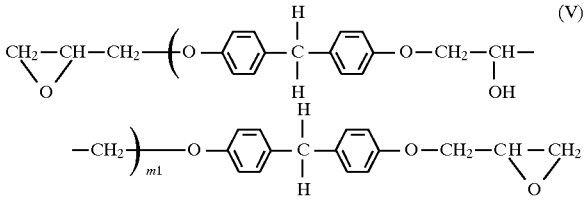

(V)

wherein m1 is an integer of 0 to 33, and the bromide is represented by the formula (VI):

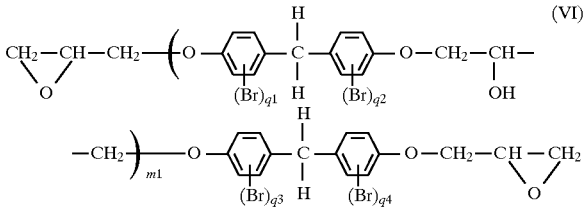

(VI)

wherein m2 is an integer of 0 to 33, and q1, q2, q3, and q4 are independently an integer of 1 or 2, and wherein the total amount of the bisphenol F diglycidyl ether of formula (V) wherein m1 is 0 and/or the bromide of formula (VI) wherein m2 is 0 is not more than 2% by weight of the total amount of the bisphenol F diglycidyl ether of formula (V) and/or the bromide of formula (VI).

2. The thermal transfer recording material of claim 1, wherein the content of the epoxy resin in the vehicle is not less than 95% by weight.

3. The thermal transfer recording material of claim 1, which further comprises a layer comprising a wax provided between the foundation and the heat-meltable ink layer, the layer comprising the wax having a penetration of not more than 1.

4. A thermal transfer recording material for forming a color image comprising at least one region wherein a color is developed by virtue of subtractive color mixture of at least two superimposed inks selected from a yellow heat-meltable ink, a magenta heat-meltable ink and a cyan heat-meltable ink, the thermal transfer recording material comprising a foundation, and a yellow heat-meltable ink layer, a magenta heat-meltable ink layer and a cyan heat-meltable ink layer provided on the foundation in a side-by-side relation, each of the respective color heat-meltable ink layers comprising a vehicle and a pigment, the vehicle comprising not less than 85% by weight of an epoxy resin, the epoxy resin comprising not less than 50% by weight of at least one of bisphenol F diglycidyl ether and a bromide thereof, wherein the bisphenol F diglycidyl ether is represented by formula (V):

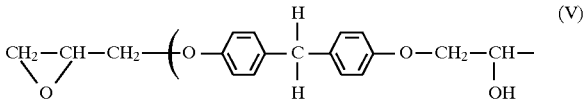

(V)

-continued

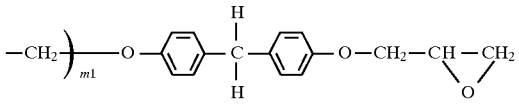

wherein m1 is an integer of 0 to 33, and the bromide is represented by the formula (VI):

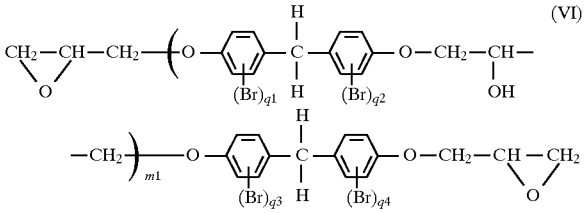

(VI)

wherein m2 is an integer of 0 to 33, and q1, q2, q3, and q4 are independently an integer of 1 or 2, and wherein the total amount of the bisphenol F diglycidyl ether of formula (V) wherein m1 is 0 and/or the bromide of formula (VI) wherein m2 is 0 is not more than 2% by weight of the total amount of the bisphenol F diglycidyl ether of formula (V) and/or the bromide of formula (VI).

5. An assembly of plural thermal transfer recording materials for forming a color image comprising at least one region wherein a color is developed by virtue of subtractive color mixture of at least two superimposed inks selected from a yellow heat-meltable ink, a magenta heat-meltable ink and a cyan heat-meltable ink, the assembly comprising a first thermal transfer recording material comprising a foundation and a yellow heat-meltable ink layer provided on the foundation, a second thermal transfer recording material comprising a foundation and a magenta heat-meltable ink layer provided on the foundation, and a third thermal transfer recording material comprising a foundation and a cyan heat-meltable ink layer provided on the foundation, each of the respective color heat-meltable ink layers comprising a vehicle and a pigment provided on the foundation, the vehicle comprising not less than 85% by weight of an epoxy resin, the epoxy resin comprising not less than 50% by weight of at least one of bisphenol F diglycidyl ether and a bromide thereof, wherein the bisphenol F diglycidyl ether is represented by formula (V):

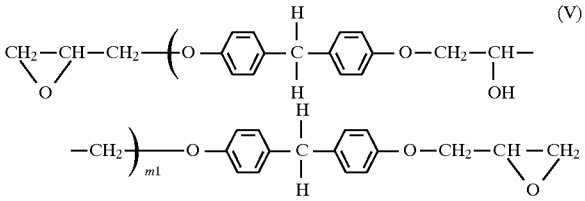

(V)

wherein m1 is an integer of 0 to 33, and the bromide is represented by the formula (VI):

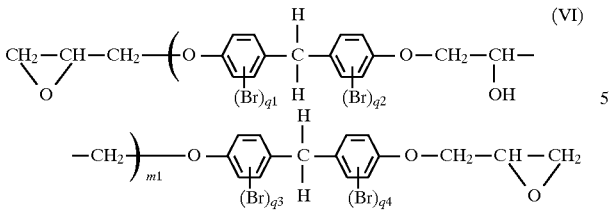
(VI)
wherein m2 is an integer of 0 to 33, and q1, q2, q3, and q4 are independently an integer of 1 or 2, and
wherein the total amount of the bisphenol F diglycidyl ether of formula (V) wherein m1 is 0 and/or the bromide of formula (VI) wherein m2 is 0 is not more than 2% by weight of the total amount of the bisphenol F diglycidyl ether of formula (V) and/or the bromide of formula (VI).
* * * * *

UNITED STATES PATENT AND TRADEMARK OFFICE

CERTIFICATE OF CORRECTION

PATENT NO. : 5,773,149

DATED : June 30, 1998

INVENTOR(S) : Yoshida et al

It is certified that error appears in the above-identified patent and that said Letters Patent is hereby corrected as shown below:

Column 4, line 37; column 41, line 20; column 42, line 18; and column 43, line 9, in Formula (VI) delete "$-CH_2)_{m1}-O$" and substitute therefor -- $-CH_2)_{m2}-O$ --.

Column 6, line 46 delete "glycidyloxy" and substitute therefor -- glycidoxy --.

Column 7, line 12; column 9, line 49; column 12, line 58; and column 15, line 5 delete "50" and substitute therefor -- 50% --.

Column 16, Formula (IX) delete "$(Br)_{q4}$" and substitute therefor -- $(Br)_{r4}$ --.

Column 18, line 19 delete "frog." and substitute therefor -- from --.

UNITED STATES PATENT AND TRADEMARK OFFICE

CERTIFICATE OF CORRECTION

PATENT NO. : 5,773,149

DATED : June 30, 1998

INVENTOR(S) : Yoshida et al

It is certified that error appears in the above-identified patent and that said Letters Patent is hereby corrected as shown below:

Column 18, line 60 delete "riot" and substitute therefor -- not --.

Column 18, line 65 delete "form."

Column 22, line 56 delete "mJ/mM$^2$" and substitute therefor -- mJ/mm$^2$ --.

Column 27, Table 2-1 delete "Araidite" and substitute therefor -- Araldite --.

Column 29, line 44 delete "latter)" and substitute therefor -- layer) --.

Signed and Sealed this

Seventeenth Day of October, 2000

*Attest:*

*Attesting Officer*

Q. TODD DICKINSON

*Director of Patents and Trademarks*